US008593246B2

(12) United States Patent
Soltani et al.

(10) Patent No.: US 8,593,246 B2
(45) Date of Patent: Nov. 26, 2013

(54) REACTOR AND PRODUCTION METHOD THEREOF

(75) Inventors: Bahman Hossini Soltani, Chiryu (JP); Motohiro Ishibashi, Anjo (JP); Hiroaki Mizuno, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 13/327,814

(22) Filed: Dec. 16, 2011

(65) Prior Publication Data

US 2012/0154088 A1 Jun. 21, 2012

(30) Foreign Application Priority Data

Dec. 17, 2010 (JP) ..... 2010-281181

(51) Int. Cl.

| | |
|---|---|
| ***H01F 27/02*** | (2006.01) |
| ***H01F 27/06*** | (2006.01) |
| ***H01F 27/28*** | (2006.01) |
| ***H01F 27/30*** | (2006.01) |
| ***H01F 27/26*** | (2006.01) |

(52) U.S. Cl.
USPC ..... 336/92

(58) Field of Classification Search
USPC ..... 336/65–68, 83, 90, 92, 96, 98, 184, 336/209, 210
See application file for complete search history.

(56) References Cited

U.S. PATENT DOCUMENTS

| | | | | | |
|---|---|---|---|---|---|
| 5,685,065 | A | * | 11/1997 | Suzuki et al. | 29/606 |
| 5,764,124 | A | * | 6/1998 | Nakamichi et al. | 336/92 |
| 2010/0123541 | A1 | | 5/2010 | Saka et al. | |

FOREIGN PATENT DOCUMENTS

| | | | | |
|---|---|---|---|---|
| JP | P2007-116066 | A | | 5/2007 |
| JP | 2009130965 | A | * | 6/2009 |
| JP | P2010-082921 | A | | 4/2010 |
| JP | P2010-118574 | A | | 5/2010 |
| JP | 2010212632 | A | * | 9/2010 |
| JP | P2010-212632 | A | | 9/2010 |

* cited by examiner

*Primary Examiner* — Tsz Chan
(74) *Attorney, Agent, or Firm* — Nixon & Vanderhye P.C.

(57) ABSTRACT

A reactor which may be employed in an inverter for automotive vehicles. The reactor includes a coil, a core, a casing, and a positioning member. The core is made of a solidified magnetic powder/resin mixture and has the coil embedded therein. The positioning member is disposed in the casing to position the coil relative to the casing and equipped with fins configured to stir the magnetic powder/resin mixture before solidified. Specifically, the positioning member is designed to perform two functions: one is to fix the location of the coil within the casing, and the other is to stir the magnetic powder/resin mixture through the fins, thus eliminating the need for removing a portion of the magnetic powder/resin mixture adhered to the fins, which leads to improved productivity of the reactor.

9 Claims, 21 Drawing Sheets

REACTOR AND PRODUCTION METHOD THEREOF

CROSS REFERENCE TO RELATED DOCUMENT

The present application claims the benefit of priority of Japanese Patent Application No. 2010-281181 filed on Dec. 17, 2010, the disclosure of which is incorporated herein by reference.

BACKGROUND OF THE INVENTION

1. Technical Field

This disclosure relates generally to a reactor which is made up of a core made of a mixture of magnetic powder and resin and a coil wound in the core and a production method thereof.

2. Background Art

FIG. 23 illustrates a reactor 9 for use in an inverter for automotive vehicles. The reactor 9 includes a core 93 made of a mixture of magnetic powder and insulating resin and a coil 92 installed in the core 93. For example, Japanese Patent First Publication Nos. 2010-212632 and 2010-118574 disclose such a type of reactor.

The production of the reactor 9 is, as illustrated in FIG. 24, achieved by putting resin material and magnetic powder in a casing 94 and kneading them so that the magnetic power may be dispersed in the resin material to make a magnetic powder/resin mixture 930 (see an arrow P1). Subsequently, the coil 92 is embedded in place within the magnetic powder/resin mixture 930 (see an arrow P2). The magnetic powder/resin mixture 930 is solidified to make the core 93. This forms the reactor 9, as illustrated in FIG. 23, made up of the coil 93 which is embedded in the core 93 made of the magnetic powder/resin mixture 930 within the casing 94.

The production of the reactor 9 requires, as described above, kneading of the magnetic powder/resin mixture 930 using a stirring blade 95. After the magnetic powder/resin mixture 930 is kneaded, the magnetic powder/resin mixture 930 will be partly adhered to the stirring blade 95 in the form of layers of reactor material 931. It is, thus, necessary to remove the reactor material 931 from the stirring blade 931. Such removal requires solvent, the washing bath 992, and the drying box 993 as well as consumption of the operator's time.

Specifically, after the magnetic powder/resin mixture 930 is kneaded, the stirring blade 95 is, as indicate by the arrow Q1, detached from the stirring motor 991 and then put, as indicated by the arrow Q2, in the washing bath 992. The reactor material 931 is removed from the stirring blade 95 using solvent within the washing bath 992. Subsequently, the stirring blade 95 is, as indicated by the arrow Q3, put in the drying box 993 and then dried to remove the solvent therefrom. The stirring blade 95 is, as indicated by the arrow Q4, taken out of the drying box 993 and then used, as indicated by the arrow Q5, in kneading the magnetic powder/resin mixture 930 in the next production process. A sequence of the operations, as indicated by the arrows Q1 to Q5, are performed cyclically to knead the magnetic powder/resin mixture 930 for mass-producing the reactor 9.

The removal of the reactor material 931 from the stirring blade 95, as just described, consumes much of the operator's time and effort, and requires the use of solvent, the washing bath 992, and the drying box 993, thus resulting in an increase in production cost of the reactor 9.

After removed from the stirring blade 95, the reactor material 931 is usually discarded, thus resulting in a decrease in yield of the reactor 9.

If the solvent remains accumulated on the surface of the stirring blade 95, it may adversely affect the kneading of the magnetic powder/resin mixture 930 in the following production process, which results in degradation of the performance of the core 93. Additionally, a variation in amount of the reactor material 931 adhered to the stirring blade 95 will result in a variation in volume of the core 93, that is, a unit-to-unit variation in size of the reactor 9, which usually leads to a decrease in reliability in operation of the reactor 9.

SUMMARY

It is therefore an object to provide a reactor which is excellent in productivity, material yield rate, and reliability in operation and a production method thereof.

According to one aspect of an embodiment, there is provided a reactor which may be employed in an inverter for automotive vehicles. The reactor comprises: (a) a coil that produces a magnetic flux when energized; (b) a core that is made of a solidified magnetic powder/resin mixture and has the coil embedded therein; (c) a casing in which the coil and the core are disposed; and (d) a positioning member disposed in the casing to position the coil relative to the casing, the positioning member being equipped with fins configured to stir the magnetic powder/resin mixture before solidified.

Specifically, the positioning member is designed to perform two functions: one is to fix a location of the coil within the casing, and the other is to stir the magnetic powder/resin mixture through the fins before the magnetic powder/resin mixture is solidified. Usually, after the magnetic powder/resin mixture is stirred, a portion thereof remains adhered to the fins of the positioning member. The positioning member is, however, left in the magnetic powder/resin mixture after being stirred in order to position the coil relative to the casing, thus eliminating the need for removing the portion of the magnetic powder/resin mixture adhered to the fins. This also eliminates the need for solvent used to remove the magnetic powder/resin mixture, and washing and drying facilities such as the ones discussed in the introductory part of this application, thus resulting in improvement on the productivity of the reactor.

The fins are embedded in the core as the part of the positioning member, so that the portion of the magnetic powder/resin mixture adhered to the fins will be a portion of the core, thereby enhancing the yield rate of the material of the reactor.

It is, as described above, unnecessary to remove the portion of the magnetic powder/resin mixture adhered to the fins of the positioning member, thus eliminating the problem, as encountered by the prior art structure discussed in the introductory part of this application, that the stirring blade with the solvent may be used again to stir the magnetic powder/resin mixture in the subsequent production process. The required performance of the reactor is, thus, ensured. Moreover, a variation in size of the core of the reactor arising from a variation in volume of the portion of the magnetic powder/resin mixture adhered to the positioning member is eliminated, thus avoiding the unit-to-unit variation in size of the reactor, which usually leads to a decrease in reliability in operation of the reactor.

The fins are formed by a portion of the positioning member, thus eliminating the need for use of an additional agitator to stir the magnetic powder/resin mixture, thus avoiding an increase in number of parts of the reactor.

The positioning member may be made of material which is higher in thermal conductivity than the core and placed in contact abutment with an inner wall of the casing, thus facilitating the ease with which the heat, as generated by the coil and the core, is dissipated outside the reactor and minimizing a rise in temperature of the reactor.

The positioning member may be made of a magnetic material. the positioning member 5 may be made of a magnetic material. This eliminates the interference of the positioning member with magnetic paths in the reactor and minimizes a change in magnetic characteristics of the reactor arising from the presence of the positioning member. The degree of freedom of designing the shape of the positioning member is, therefore, increased, thus facilitating ease with which the high-strength positioning member is produced.

The positioning member may be formed integrally therewith a bobbin around which the coil is wound. This results in a decrease in number of part of the reactor and improved productivity of the reactor.

The casing is made up of a bottom and a cylindrical side wall extending from a peripheral edge of the bottom. The coil has ends opposed to each other in an axial direction thereof and is disposed with one of the opposed ends facing the bottom of the casing. The positioning member has an annular frame on which the coil is disposed at one of the opposed ends thereof and the fins formed on an outer circumference of the annular frame. This enhances the efficiency in stirring the magnetic powder/resin mixture through rotation of the positioning member.

The positioning member may also include spokes extending radially inside the annular frame and inner fins formed on the spokes. This further enhances the efficiency in stirring the magnetic powder/resin mixture.

The positioning member is made of a bent metal plate and has a rib formed by a portion of the metal plate which bulges in a thickness-wise direction of the metal plate. The rib enhances the mechanical strength of the positioning member and also permits the weight of the positioning member to be decreased. The decrease in weight may be achieved by decreasing the thickness of the metal plate of the positioning member, which results in a decrease in interference thereof with the magnetic flux.

The bottom may be of a circular shape. The cylindrical side wall may be formed by a circular hollow cylinder. This minimizes the resistance to circling of the fins within the magnetic powder/resin mixture and facilitates the stirring of the magnetic powder/resin mixture.

The positioning member may be interposed between the coil and the bottom of the casing. The casing may have a round inner corner extending between the bottom and the cylindrical side wall. The round inner corner is of an arc-shape in cross section taken in an axial direction of the casing. The maximum diameter of the positioning member is smaller than a diameter of an inner circumference of the cylindrical side wall. The fins formed on the outer circumference of the annular frame each have an arc-shaped edge placed in abutment with the bottom and the inner corner of the casing. The arc-shaped edge is smaller in radius of curvature than the inner corner of the casing. This ensures the positioning of the coil both in vertical and lateral directions of the casing without sacrificing the ease of agitation of the magnetic powder/resin mixture.

According to another aspect of the embodiment, there is provided a method of producing a reactor equipped with a core in which a coil is disposed. The method comprises steps of: (a) preparing one of a vessel and a casing; (b) preparing a positioning member with fins; (c) putting a magnetic powder/resin mixture in the one of the vessel and the casing; (d) stirring the magnetic powder/resin mixture within the one of the vessel and the casing using the fins of the positioning member; (e) arranging a coil and the positioning member within the magnetic powder/resin mixture; and (f) solidifying the magnetic powder/resin mixture to make the core.

Specifically, the positioning member works to perform two functions: one is to fix a location of the coil within the one of the vessel and the casing, and the other is to stir the magnetic powder/resin mixture through the fins before the magnetic powder/resin mixture is solidified. Such a structure of the positioning member eliminates the need for removing a portion of the magnetic powder/resin mixture adhered to the fins. This also eliminates the need for solvent used to remove the magnetic powder/resin mixture, and washing and drying facilities such as the ones discussed in the introductory part of this application, thus resulting in improvement on the productivity of the reactor.

The coil may be embedded in the magnetic powder/resin mixture after the magnetic powder/resin mixture is stirred by the fins of the positioning member. The stirring of the magnetic powder/resin mixture is, therefore, achieved by moving the positioning member, which facilitates the ease of the stirring.

The method may further comprises preparing an assembly of the positioning member and the coil. The magnetic powder/resin mixture may be stirred using the fins of the positioning member of the assembly. This ensures the accuracy in positioning the positioning member and the coil relative to each other.

BRIEF DESCRIPTION OF THE DRAWINGS

The present invention will be understood more fully from the detailed description given hereinbelow and from the accompanying drawings of the preferred embodiments of the invention, which, however, should not be taken to limit the invention to the specific embodiments but are for the purpose of explanation and understanding only.

In the drawings.

DESCRIPTION OP THE PREFERRED EMBODIMENTS

Figure 1:
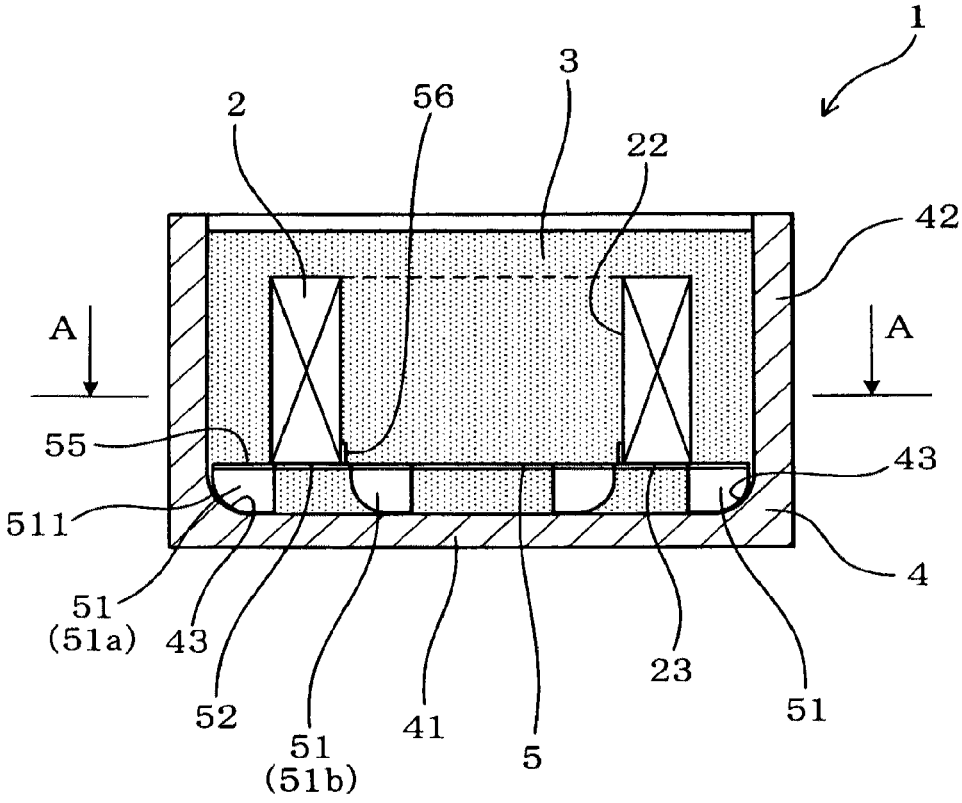
FIG. 1 is a longitudinal sectional view which shows a reactor according to the first embodiment.

Referring to the drawings, wherein like reference numbers refer to like parts in several views, particularly to FIG. 1, there is shown a reactor 1 of the first embodiment which may be employed with an inverter for automotive vehicles.

The reactor 1 includes a coil 2, a core 3, a casing 4, and a positioning member 5. When energized, the coil 2 produces a magnetic flux. The core 3 is formed by solidifying a mixture of magnetic power and resin material. The core 3 has the coil 2 embedded therein. The coil 2 and the core 3 are disposed within the casing 4. The positioning member 5 serves to fix the location of the coil 2 within the casing 4.

Figure 2:
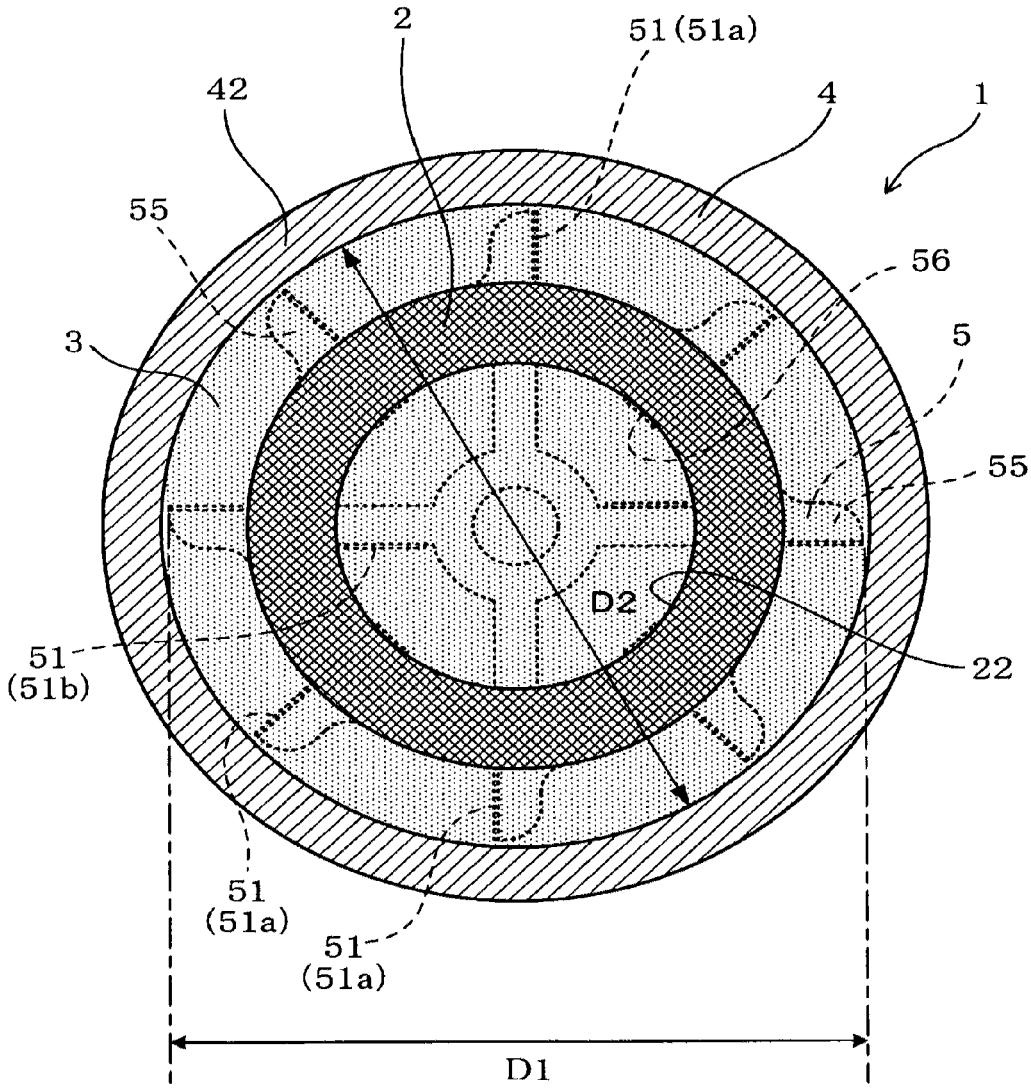
FIG. 2 is a traverse sectional view, as take along the line A-A in FIG. 1.
Figure 3:
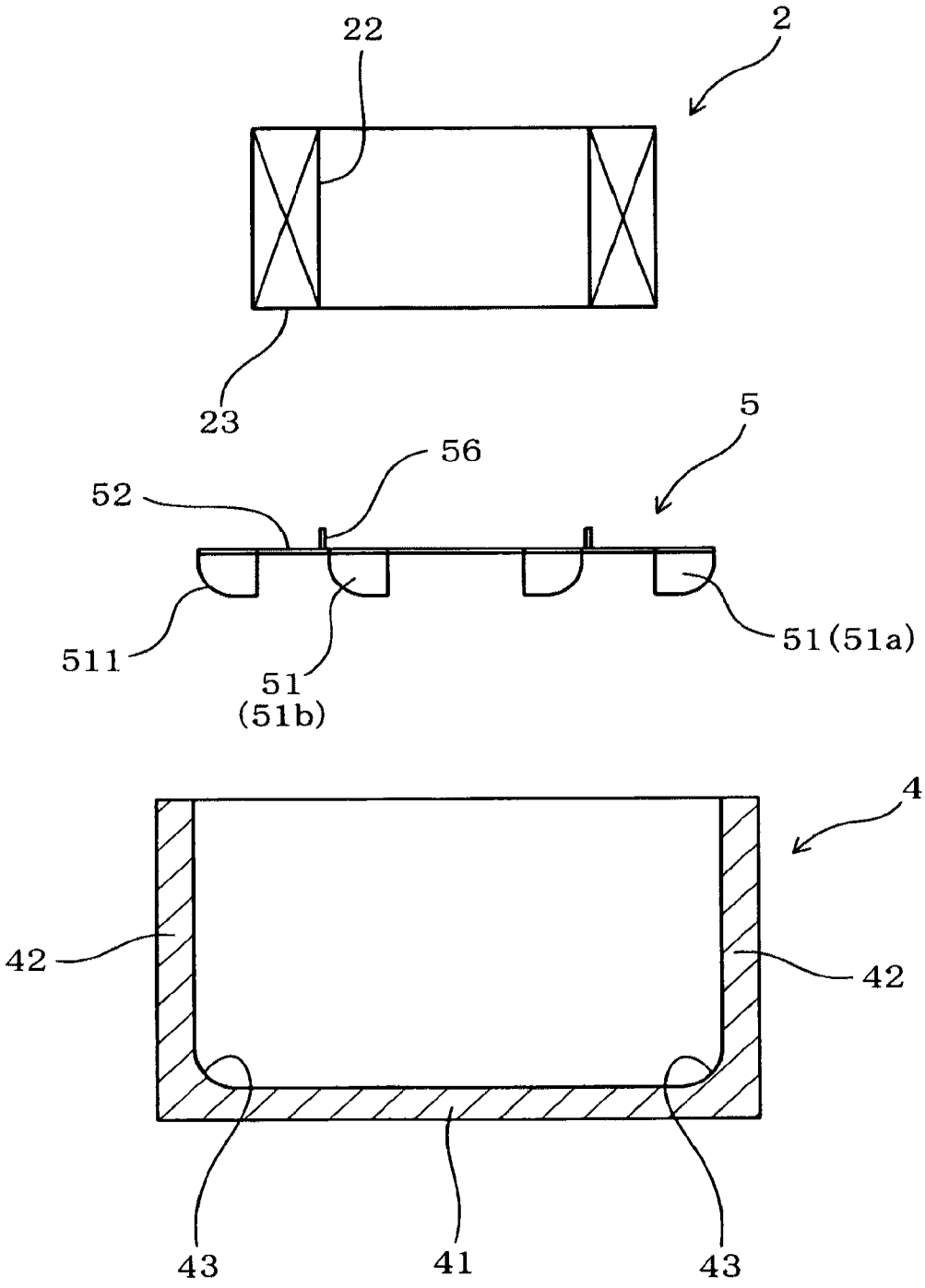
FIG. 3 is an exploded view which shows the reactor of FIG. 1.

The reactor 1 is, as illustrated in FIG. 3, designed to have the coil 2 and the positioning member 5 disposed inside the casing 4 and also have the core 3, as can be seen in FIGS. 1 and 2, in which the coil 2 is embedded.

The positioning member 5 is made of material which is higher in thermal conductivity than the core 3 and placed in contact abutment with an inner wall of the casing 4.

The casing 4 is made up of a bottom 41 and a cylindrical side wall 42 extending vertically from an edge of the bottom 41. The side wall 42 is of a hollow circular cylindrical shape. The coil 2 has ends opposed in an axial direction thereof. The coil 2 is placed within the casing 4 with one of the ends facing the bottom 41 of the casing 4. The positioning member 5 is, as illustrated in FIGS. 1, and 5 to 7, equipped with an annular frame (i.e., a rim) 52 and a plurality of tabs or fins 51. The annular frame 52 is disposed within the casing 4 in contact abutment with the end of the coil 2. The fins 51 extending from an outer periphery of the annular frame 52 will also be referred to as outer fins 51*a*, below.

The positioning member 5 also includes an annular hub 54 and a plurality of spokes 53 radiating from the hub 54 to the annular frame 52. Each of the spokes 53 has the fin 51. The fins 51 of the spokes 53 will also be referred to as inner fins 51*b* below.

The bottom 41 of the casing 4 is, as illustrated in FIGS. 1 to 3, of a circular shape. The side wall 42 is of a hollow cylindrical shape.

Figure 4:
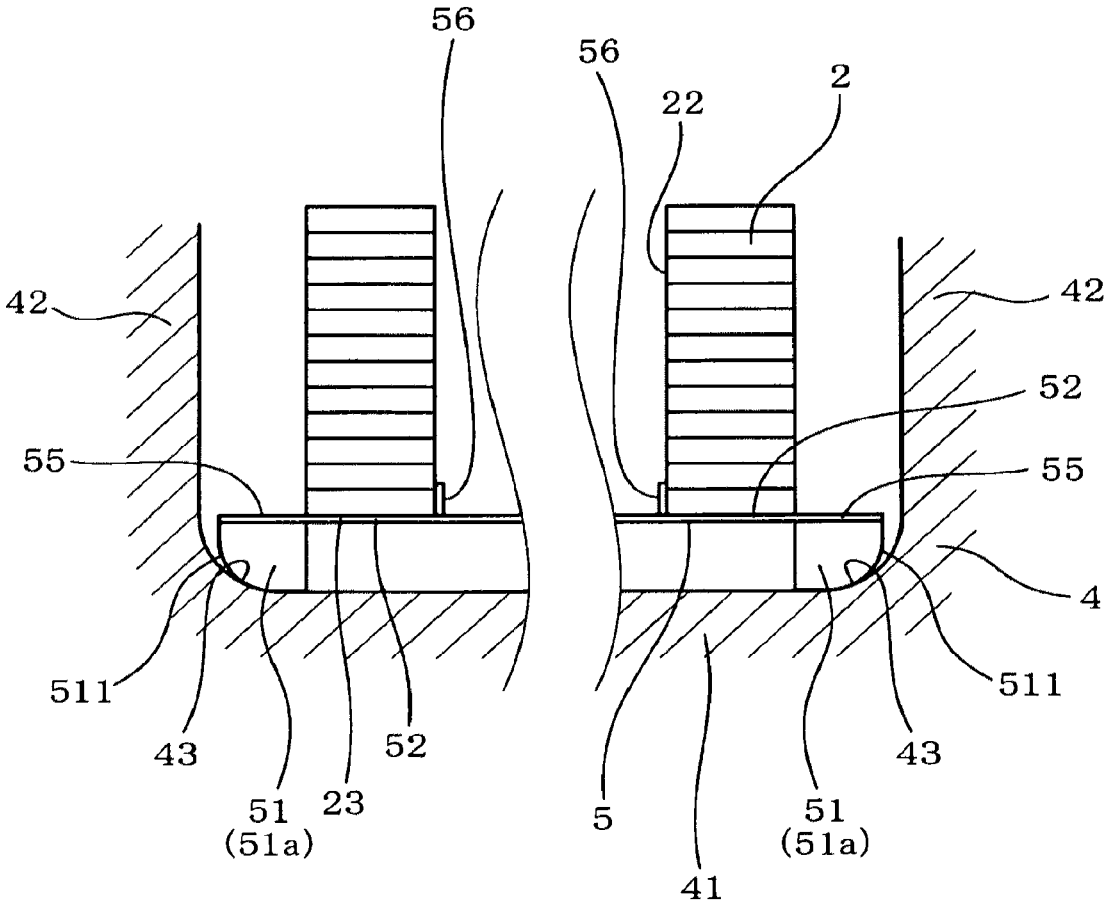
FIG. 4 is a partial enlarged sectional view which shows a positioning member of the reactor of FIG. 1 which is disposed in a casing to position a coil relative to the casing.

The positioning member 5 is interposed between the bottom 41 of the casing 4 and the coil 2. The casing 4 has an inner corner 43 extending between the lower end of the side wall 42 and the bottom 41. The inner corner 43 is, as can be seen in FIGS. 1 and 3, curved outwardly of the casing 4. In other words, the inner corner 43 has a surface rounded into an arc-shape in cross section as taken in a vertical direction in FIG. 3 (i.e., the axial direction of the casing 4). The maximum diameter D1 of the positioning member 5 is, as can be seen in FIG. 2, smaller than the inner diameter D2 of the side wall 42 of the casing 4. Each of the outer fins 51*a*, as can be seen in FIG. 4, has an arc-shaped edge 511 which is placed in contact with the inner corner 43 of the casing 4. Each of the arc-shaped edge 551 is substantially contoured to conform with the contour of the inner corner 43, but is smaller in radius of curvature than the inner corner 43. Each of the arc-shaped edge 551 is placed in contact abutment with the inner surfaces of the bottom 41 and the inner corner 43.

Figure 5:
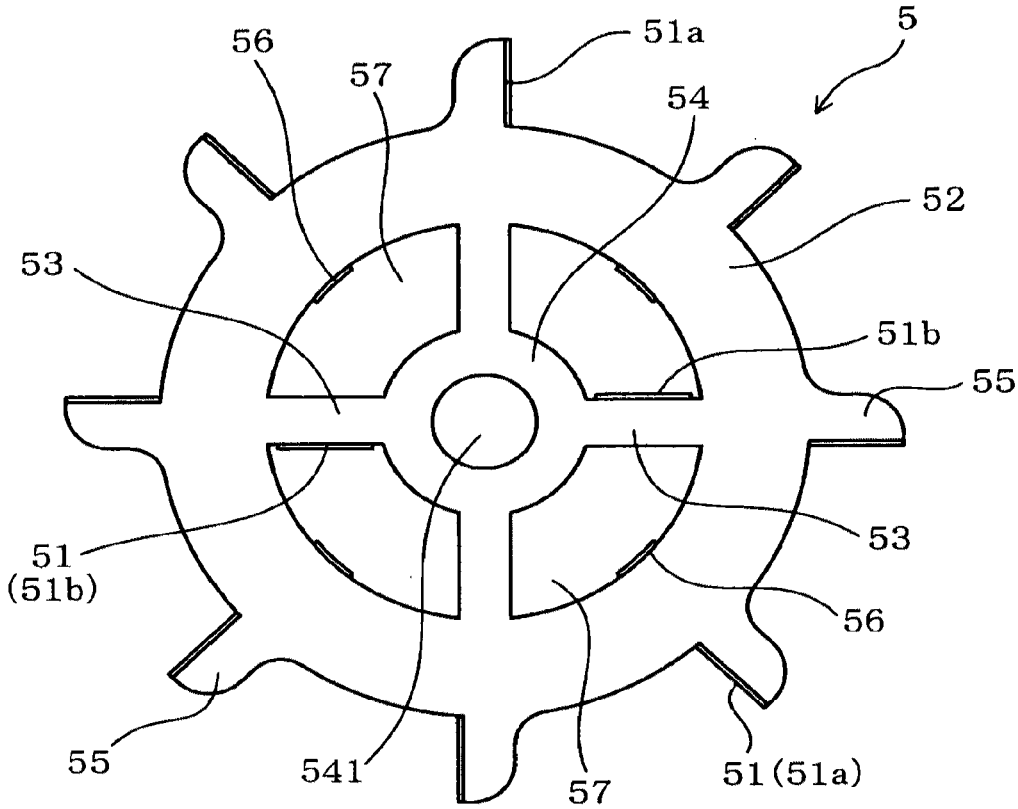
FIG. 5 is a plane view of the positioning member of FIG. 4.

The positioning member 5 is formed by punching a metallic plate such as stainless steel plate or aluminum plate into a shape, as illustrated in FIG. 5, and bending it to make the fins 51 and coil holders 56, as will be described later in detail. The positioning member 5, as illustrate in FIGS. 5 to 7, has the annular hub 54 disposed inside the annular frame 52 coaxially therewith. The hub 54 is smaller in diameter than the annular frame 52. The spokes 53 extend radially from the hub 54 to the annular frame 52 at a regular interval.

The positioning member 5 also includes eight outer protrusions 55 extending radially from the annular frame 52 outward. The protrusions 55 are arrayed at a regular angular interval away from each other. Each of the protrusions 55 has one of the outer fins 51*a* which extends from one of side edges thereof opposed to each other in a circumferential direction of the annular frame 52. Each of the outer fins 51*a* protrudes, as clearly shown in FIGS. 2 and 3, in a direction passing through the center of the bottom 41 of the casing 4 when the positioning member 5 is disposed within the casing 4. This direction will also be referred to as a vertical direction below.

The casing 4 is oriented with the bottom 41 facing in a vertical direction at least until a magnetic powder/resin mixture is put in the casing 4 and solidified. In the following discussion, a direction in which an outer surface of the bottom 41 faces when the magnetic powder/resin mixture is being stirred or kneaded will be referred to as a downward direction. The opposite of the downward direction will be referred to as an upward direction. In use, the reactor 1 is not always oriented with the bottom 41 facing in the downward direction, but may be installed in, for example, an automotive vehicle at different orientations.

Each of the outer fins 51*a*, as can be seen in FIG. 5, occupies the whole of the straight side edge of one of the protrusions 55. The peripheral edge of each of the protrusions 55 other than the straight side edge from which the outer tab 51*a* extends is, as can be seen in FIG. 5, curved. Specifically, the peripheral edge other than the straight side edge has a substantially round top which bulges outward of the protrusion 55 and leads to the straight side edge. The peripheral edge also has a round base which bulges inward of the annular frame 52 and leads to the outer circumference of the annular frame 52.

The inner fins 51*b* are formed on side edges of two of the spokes 52 which extend from the hub 54 in opposite directions (i.e., lateral directions, as viewed in FIG. 5). The inner fins 51*b* face downward in a thickness-wise direction of the outer protrusions 55. The other two spokes 52 may also have the inner fins 51*b*.

Each of the inner fins 51*b* occupies the overall length of one of the spokes 52 between the outer circumference of the hub 54 and the inner circumference of the annular frame 52.

The annular frame 52 also have the four coil holders 56 which are formed by rectangular fins extending from the inner circumference of the annular frame 54 in the thickness-wise direction thereof. The coil holders 56 are arrayed at a regular intervals away from each other to retain the coil 2 mechanically.

The annular frame 52, the spokes 53, the hub 54, and the outer protrusions 55 of the positioning member 5 are flush with each other and placed parallel to the bottom 41 when disposed within the casing 4. The fins 51 (i.e., the outer fins 51*a* and the inner fins 51*b*) and the coil holders 56 extend substantially perpendicular to the major surface of the annular frame 52.

The positioning member 5 also has open windows 57 defined by the inner circumference of the annular frame 52, the spokes 53, and the outer circumference of the hub 54. The hub 54 has a circular center opening 541 formed therein. The windows 57 serve to minimize the blocking of flux paths by the positioning member 5.

It is advisable that the width of the annular frame 52 in the radial direction of the positioning member 5 be identical with or smaller than that of a lower surface 23 of the coil 2, as illustrated in FIG. 4, in order to avoid the overhang of the annular frame 52 from an outer and/or inside circumference of the coil 2 for ensuring as much flux path as possible.

Referring back to FIG. 1, the reactor 1 has the positioning member 5 embedded in the core 3. The positioning member 5 is placed within the casing 4 in contact abutment at the fins 51 with the bottom 41.

The hollow cylindrical coil 2 is disposed on the annular frame 52 of the positioning member 5 with the axis thereof oriented in the vertical direction. The coil 2 is retained firmly at the inner circumference thereof by the coil holders 56 of the positioning member 5, so that the coil 2 is positioned in place in the radial direction of the positioning member 5.

The positioning member 5 on which the coil 2 is mounted is, as described above, arranged within the casing 4 in abutment at the outer and inner fins 51*a* and 51*b* with the inner surface of the bottom 41 of the casing 4 and also in abutment at the outer fins 51*a* with the inner corner 43 of the casing 4, thereby positioning the coil 2 both in the vertical direction and in the lateral direction (i.e., the radial direction of the reactor 1).

Figure 8A:
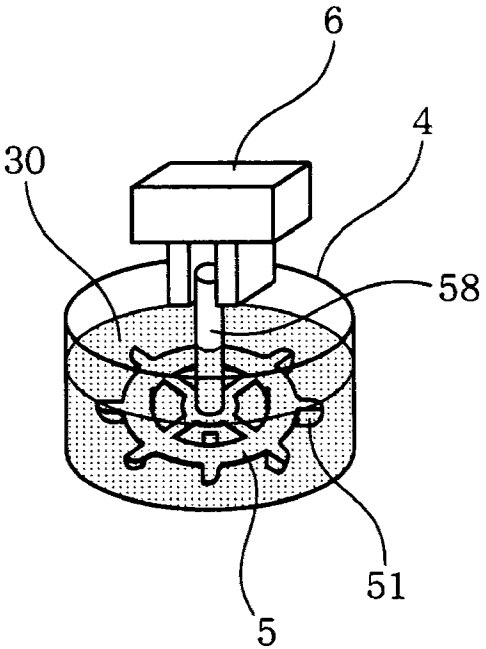
FIGS. 8(*a*), 8(*b*), and 8(*c*) are perspective views which represent a sequence of steps of producing the reactor of FIG. 1.
Figure 8B:
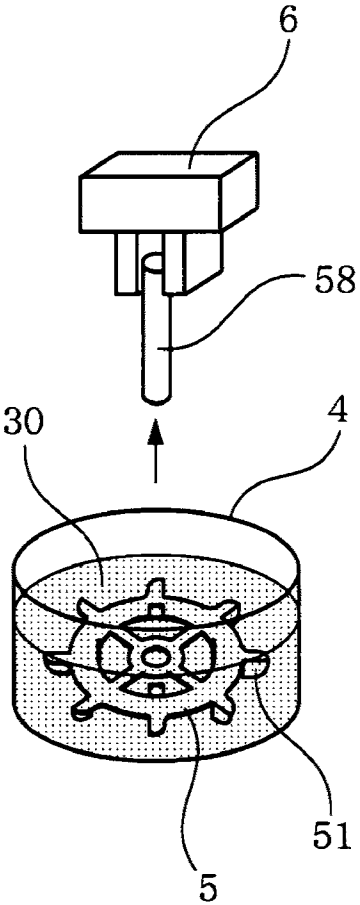
Figure 8C:
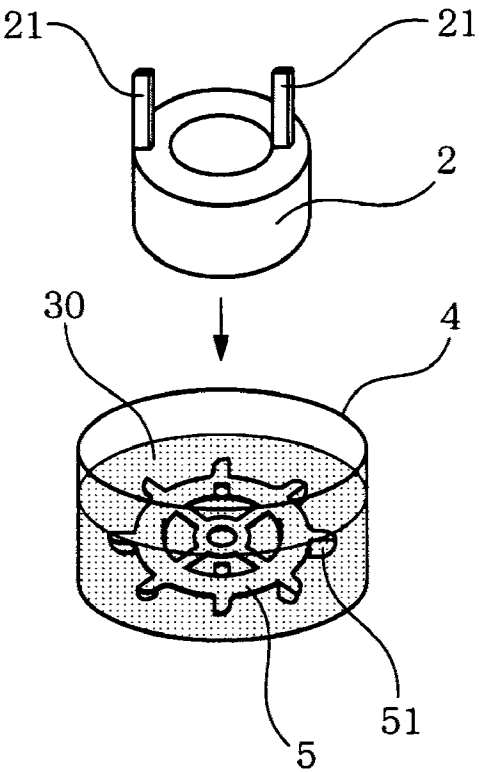

The production of the reactor 1 is achieved, as illustrated in FIGS. 8(*a*) to 8(*c*), by putting insulating resin and magnetic powder (i.e., the magnetic powder/resin mixture 30) in the casing 4, stirring or kneading the magnetic powder/resin mixture 30 using the fins 51 of the positioning member 5, arranging the positioning member 5 within the magnetic powder/resin mixture 30 along with the coil 2, and then solidifying the magnetic powder/resin mixture 30.

Specifically, required quantities of insulating resin and magnetic powder are, as illustrated in FIG. 4(*a*), first put in the casing 4. The positioning member 5 is then placed within the casing 4. The positioning member 5 may alternatively be disposed within the casing 4 before the resin and magnetic powder are input in the casing 4. The resin may be thermosetting resin such as epoxy. The magnetic powder may be iron powder. In the following discussion, both the resin within which the magnetic powder has been dispersed and the resin into which the magnetic powder has been blended, but not yet dispersed will be referred to as the magnetic powder/resin mixture 30 below.

The positioning member 5 is put in the casing 4 with a shaft 58 secured to the hub 54. The shaft 58 is made of a cylindrical rod and fit in the center opening 541 of the hub 54 so that it stands upright perpendicular to the positioning member 5. When the positioning member 5 is placed within the casing 4, the shaft 58 will be oriented to have an axis thereof extending in the upward direction of the casing 4 (i.e., the magnetic powder/resin mixture 30).

Figure 9A:
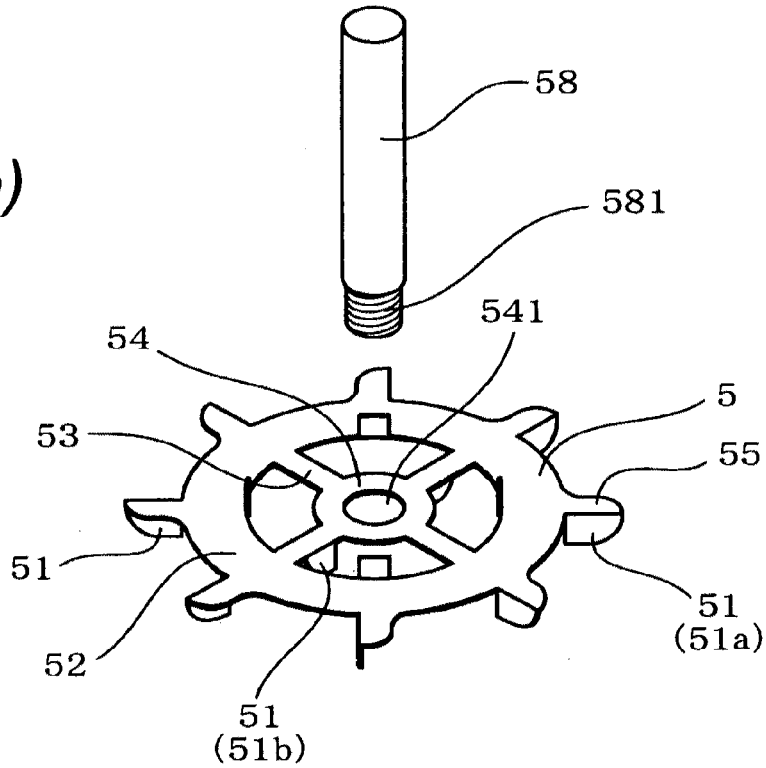
FIGS. 9(*a*) and 9(*b*) are perspective views which illustrate a positioning member and a shaft screwed into the positioning member in the first embodiment.
Figure 9B:
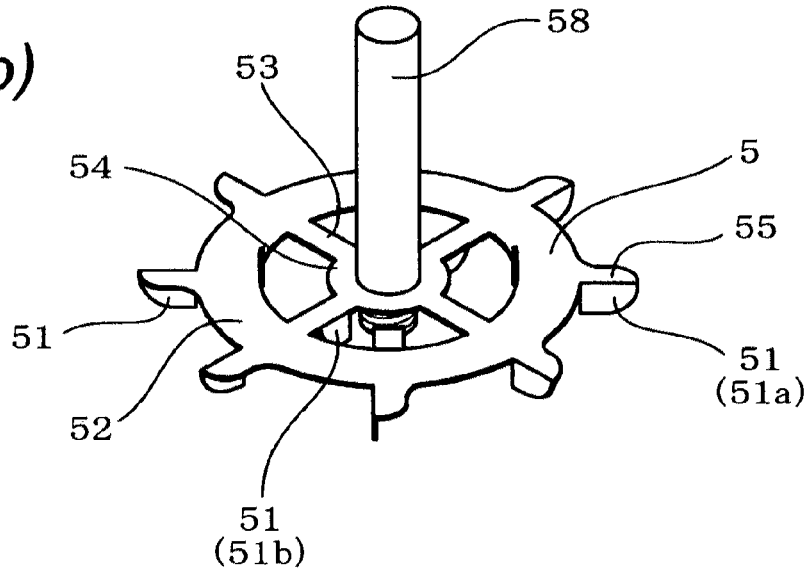
Figure 10A:
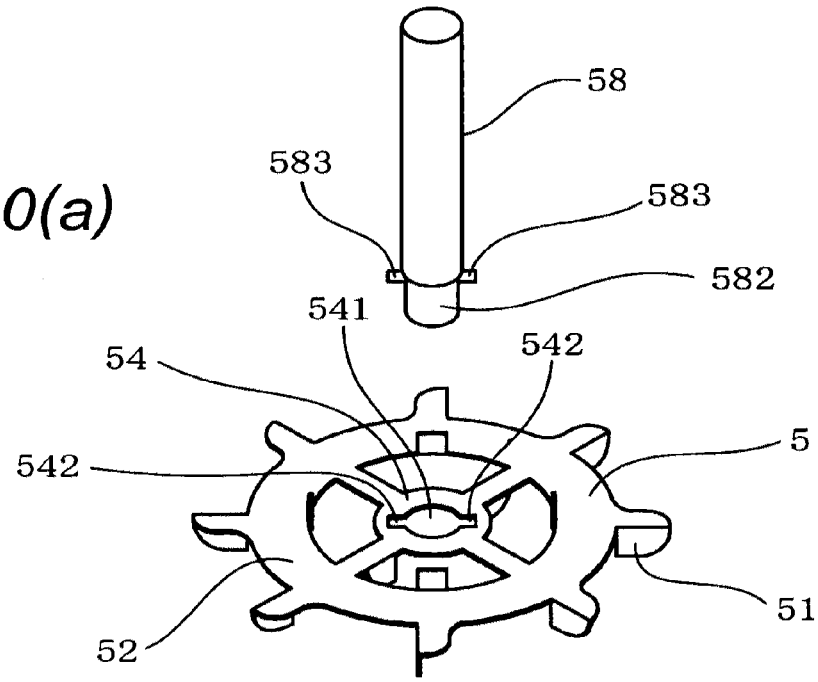
FIGS. 10(*a*) and 10(*b*) are perspective views which illustrate modifications of the positioning member and the shaft of FIGS. 9(*a*) and 9(*b*)
Figure 10B:
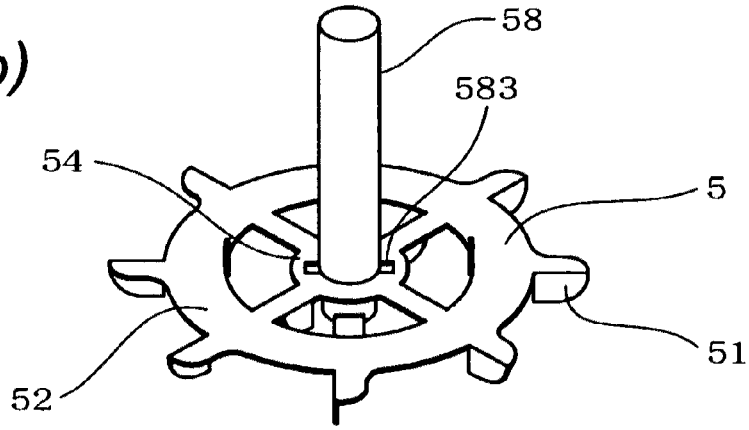

The shaft 58 is, as illustrated in FIGS. 9(*a*) and 9(*b*), has an external thread 581 formed on a lower end portion thereof. The external thread 581 is screwed into the center opening 541 of the hub 54 of the positioning member 5 in engagement with an internal thread formed in an inner periphery of the hub 54. The shaft 58 may alternatively have, as illustrated in FIGS. 10(*a*) and 10(*b*), a small-diameter end 582 and stopper pins 583 extending radially from the small-diameter end 582. The hub 54 of the positioning member 5 has elongated openings 542 such as key grooves which extend diametrically from the inner circumference of the hub 54. The small-diameter end 582 and the stopper pins 583 of the shaft 58 are fit in the central opening 541 and the elongated openings 542 of the hub 54 to establish a mechanically detachable joint between the shaft 58 and the positioning member 5.

Next, the end of the shaft 58 is, as illustrated in FIG. 9(*a*), grasped or gripped with a grasper robot 6. The grasper robot 6 then rotates the shaft 58 to turn the positioning member 5, thereby stirring and kneading the magnetic powder/resin mixture 30 through the fins 51. The shaft 58 is rotated in the clockwise direction, as viewed in FIG. 2. It is advisable that the grasper robot 6 rotate the positioning member 5 while moving vertically toward and away from the casing 4 cyclically.

After the magnetic powder/resin mixture 30 is stirred, the shaft 58 is, as illustrated in FIG. 8(*b*), detached from the positioning member 5 and lifted up. The positioning member 5 is left in the magnetic powder/resin mixture 30 within the casing 4. The positioning member 5 is placed on the bottom 41 of the casing 4.

The coil 2 is, as illustrated in FIG. 8(*c*), embedded in the magnetic powder/resin mixture 30 with ends of two terminals 21 thereof exposed outside the magnetic powder/resin mixture 30. Note that FIGS. 1 and 3 omit the terminals 21 for the brevity of illustration.

The coil 2 is, as described in FIG. 1, mounted on the annular frame 52 of the positioning member 5 within the casing 4 and retained firmly at the inner circumference 22 by the coil holders 56.

Finally, the magnetic powder/resin mixture 30 is solidified to make the core 3 to complete the reactor 1, as illustrated in FIGS. 1 and 2.

After the positioning member 5 is disposed inside the casing 4, the shaft 58 may be kept embedded in the core 3 without being removed from the positioning member 5. This eliminates the need for detaching the shaft 58 and washing it to remove a portion of the magnetic powder/resin mixture 30 adhered to the surface of the shaft 58, thus resulting in increased production efficiency. In the case where the shaft 58 will interfere with the magnetic flux, as produced by the coil 2, the shaft 58 is preferably removed from the positioning member 5 after the magnetic powder/resin mixture 30 is stirred.

The structure of the reactor 1 of this embodiment offers the following advantages.

The positioning member 5 is equipped with the fins 51 which serve as stirring blades or an agitator to stir or knead the magnetic powder/resin mixture 30 within the casing 4. Specifically, the positioning member 5 is designed to perform two functions: one is to fix the location of the coil 2 within the casing 4 (i.e., the core 3) and the other is to stir the magnetic powder/resin mixture 30 to make the core 3. This results in improved productivity and reliability in operation of the reactor 1.

The use of the positioning member 5 in stirring the magnetic powder/resin mixture 30 within the casing 4 eliminates the need for removing a portion of the magnetic powder/resin mixture 30 sticking to the surface of the fins 51, in other words, it permits the positioning member 5 (i.e., the fins 51) to be left in the casing 4 as it is without being removed from the magnetic powder/resin mixture 30, thus also eliminating the need for solvent used to remove the magnetic powder/resin mixture 30 from the positioning member 5, and washing and drying facilities such as the ones discussed in the introductory part of this application. This improves the productivity of the reactor 1.

The fins 51 are embedded in the core 3 as the part of the positioning member 5, so that the portion of the magnetic powder/resin mixture 30 adhered to the fins 51 will be a portion of the core 3, thereby enhancing the yield rate of the material of the reactor 3.

It is, as described above, unnecessary to remove the portion of the magnetic powder/resin mixture 30 adhered to the fins 51, thus eliminating the problem, as encountered by the prior art structure discussed in the introductory part of this application, that the stirring blade with the solvent may be used again to stir the magnetic powder/resin mixture 30 in the subsequent production process. The required performance of the reactor 1 is, thus, ensured. Moreover, a variation in size of the core 3 of the reactor 1 arising from a variation in volume of the portion of the magnetic powder/resin mixture 30 adhered to the positioning member 5 is eliminated, thus avoiding the unit-to-unit variation in size of the reactor 1, which usually leads to a decrease in reliability in operation of the reactor 1.

The fins 51 are formed by a portion of the positioning member 5, thus eliminating the need for use of an additional agitator to knead the magnetic powder/resin mixture 30, thus avoiding an increase in number of parts of the reactor 1.

The positioning member 5 is made of material higher in thermal conductivity than the core 3 and disposed in contact abutment with the casing 4, thus facilitating the ease with which the heat, as generated by the coil 2 and the core 3, is dissipated outside the reactor 1 and minimizing a rise in temperature of the reactor 1.

The positioning member 5 is equipped with the annular frame 52 on which the lower surface 23 of the coil 2 is placed. The outer fins 51*a* are located outside the annular frame 52, thus enhancing the efficiency in stirring the magnetic powder/resin mixture 30 through rotation of the positioning member 5 within the casing 4.

The positioning member 5 is equipped with the spokes 53 extending inside the annular frame 52. The spokes 53 has the inner fins 51*b*. In other words, the fins 51 are located both outside and inside the annular frame 52, thereby further enhancing the efficiency in stirring the magnetic powder/resin mixture 30.

The bottom 41 of the casing 4 is, as described above, circular, while the side wall 42 is cylindrical, thereby minimizing the resistance to circling of the fins 51 within the magnetic powder/resin mixture 30 and facilitating the agitation of the magnetic powder/resin mixture 30.

The positioning member 5, as can be seen in FIG. 2, has the maximum diameter D1 which is slightly smaller than the inner diameter D2 of the side wall 42 of the casing 4. Each of the outer fins 51*a* as can be seen in FIG. 4, has the arc-shaped edge 511 which is placed in contact with the inner corner 43 of the casing 4 and smaller in radius of curvature than the inner corner 43 of the casing 4. Each of the arc-shaped edge 551 is placed in abutment with both the inner surfaces of the bottom 41 and the inner corner 43. This ensures the positioning of the coil 2 both in the vertical and lateral directions of the casing 4 (i.e., the axial and radial directions of the casing 4) without sacrificing the ease of agitation of the magnetic powder/resin mixture 30.

The reactor 1 is produced in a sequence of steps of stirring the magnetic powder/resin mixture 30 using the positioning member 5 and then embedding the coil 2 in the magnetic powder/resin mixture 30. Specifically, the stirring of the magnetic powder/resin mixture 30 is achieved only by rotating the positioning member 5 within the casing 4, thus resulting in increased ease of the stirring of the magnetic powder/resin mixture 30.

Figures 11A, 11B, 11C:
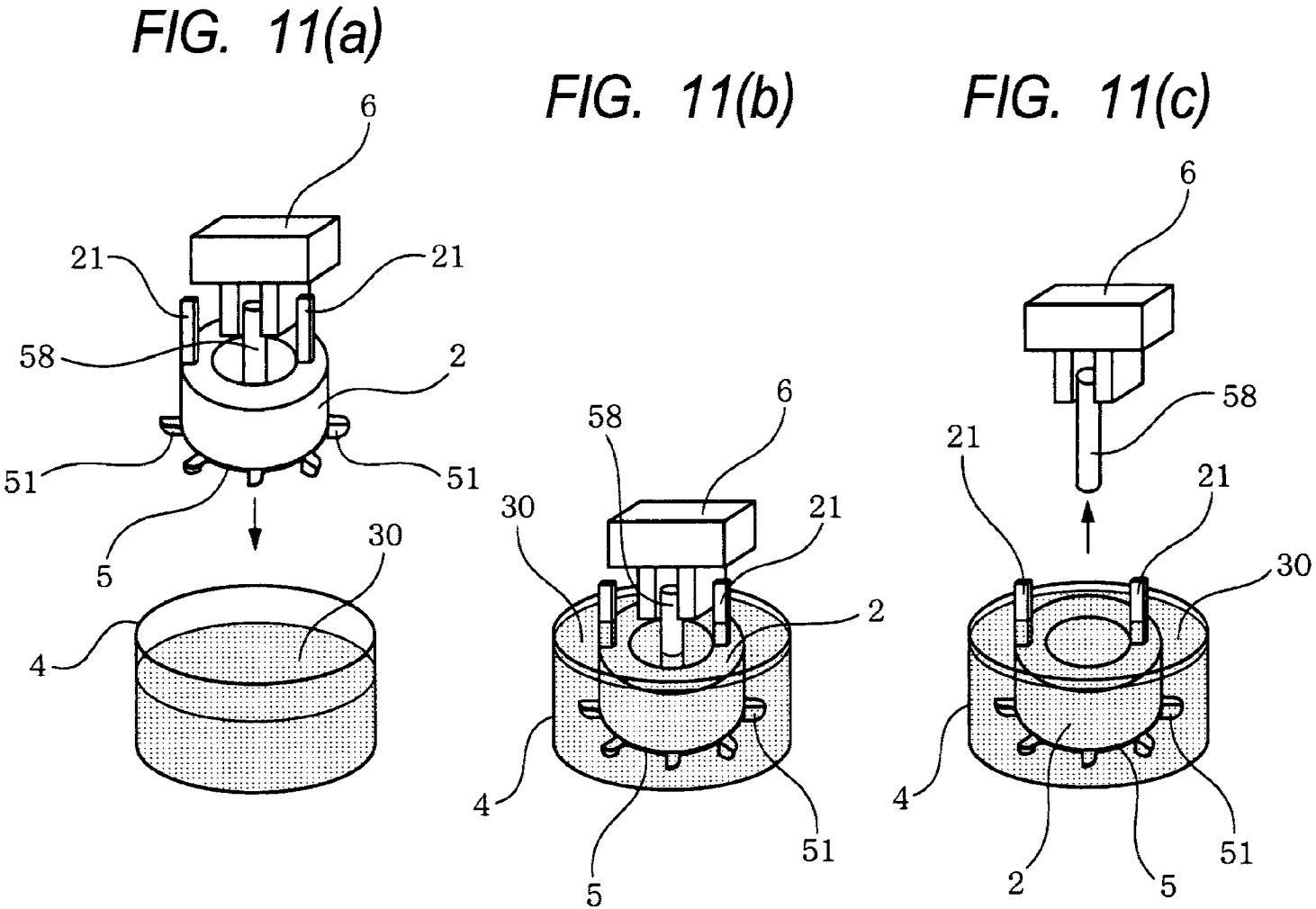
FIGS. 11(*a*), 11(*b*), and 11(*c*) are perspective views which represent a sequence of steps of producing a reactor according to the second embodiment.

FIGS. 11(*a*), 11(*b*), and 11(*c*) illustrate a sequence of steps of producing the reactor 1 according to the second embodiment. The coil 2 and the positioning member 5 are first assembled together. The magnetic powder/resin mixture 30 is, then, stirred by the fins 51 of the positioning member 5.

Specifically, required quantities of the insulating resin and the magnetic powder are, as illustrated in FIGS. 11(*a*) and 11(*b*), put in the casing 4. Next, the assembly of the positioning member 5 and the coil 2 is placed within the casing 4. The insulating resin and the magnetic powder may alternatively be put in the casing 4 after the assembly of the positioning member 5 and the coil 2 is placed within the casing 4. The shaft 58 is, like in the first embodiment, attached to the positioning member 5.

Subsequently, the end of the shaft 58 is, as illustrated in FIG. 11(*b*), grasped with the grasper robot 6. The grasper robot 6 then rotates the shaft 58 to turn the positioning member 5, thereby stirring the magnetic powder/resin mixture 30 through the fins 51. The shaft 58 is rotated in the clockwise direction, as viewed in FIG. 2. It is advisable that the grasper robot 6 rotate the positioning member 5 while moving it vertically toward and away from the casing 4 cyclically.

After the magnetic powder/resin mixture 30 is stirred, the shaft 58 is, as illustrated in FIG. 11(*c*), detached from the positioning member 5 and lifted up. The assembly of the positioning member 5 and the coil 2 is left in the magnetic powder/resin mixture 30 within the casing 4.

The rotation of the assembly of the positioning member 5 and the coil 2 may be achieved while the terminals 21 of the coil 2 are held by the grasper robot 6 or any other means.

Other production steps are the same as in the first embodiment, and explanation thereof in detail will be omitted here.

The production method of the second embodiment is to install the coil 2 on the positioning member 5 outside the casing 4 and the magnetic powder/resin mixture 30, thus increasing the accuracy in positioning the coil 2 relative to the positioning member 5.

Figure 12:
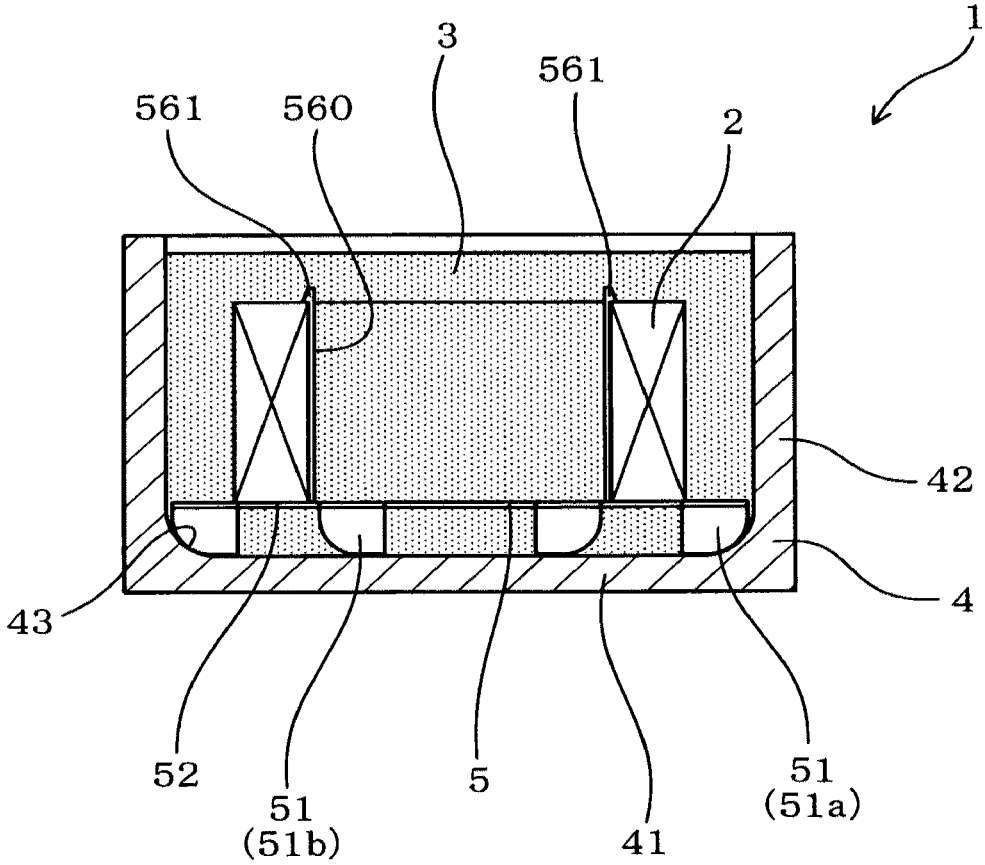
FIG. 12 is a longitudinal sectional view which shows a reactor according to the second embodiment.
Figure 13:
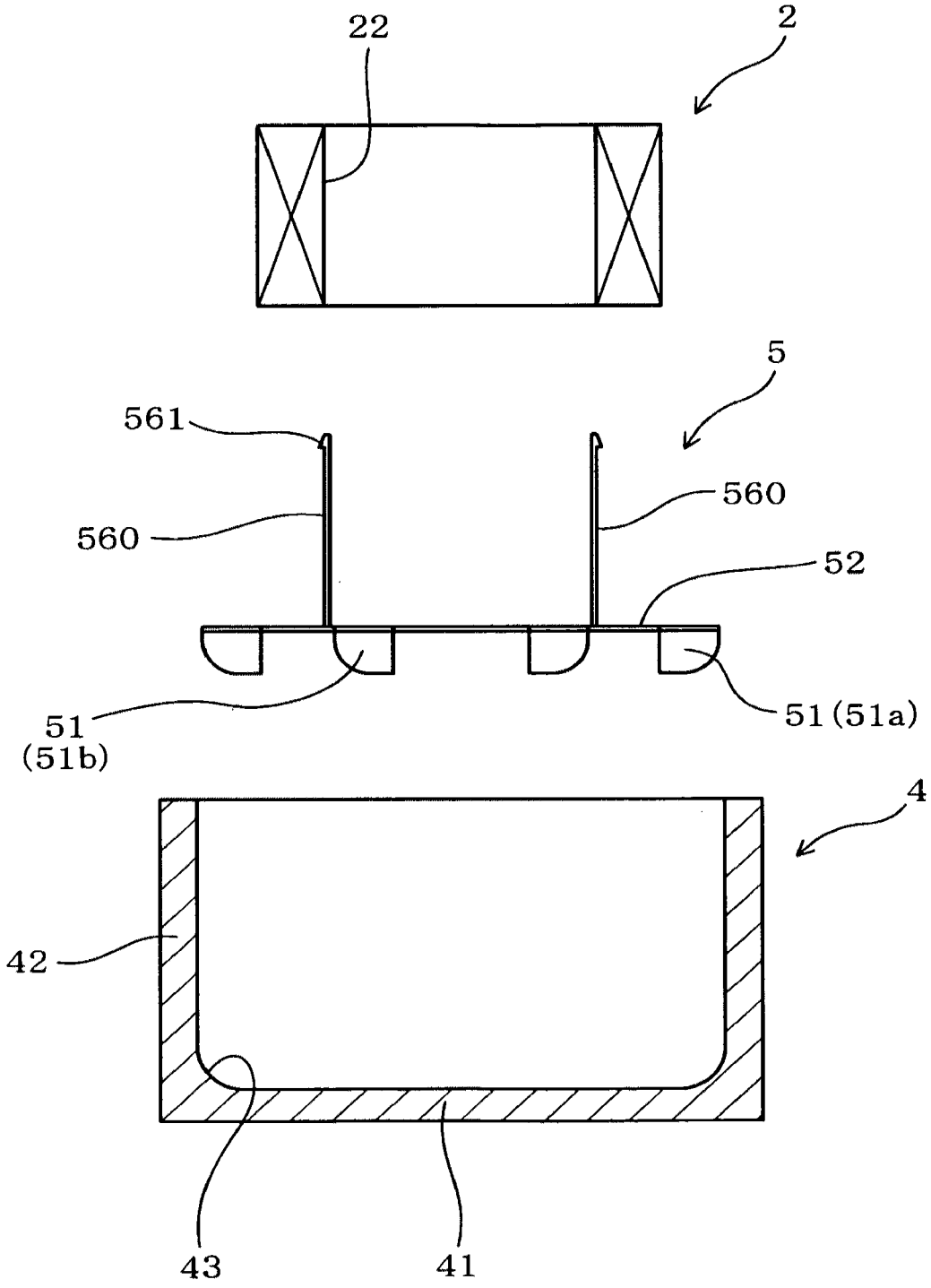
FIG. 13 is an exploded view which shows the reactor of FIG. 12.

FIGS. 12 and 13 illustrates the reactor 1 according to the third embodiment which is equipped with a bobbin 560 on which wire of the coil 2 is wound.

Specifically, the positioning member 5 has the bobbin 560 formed integrally therewith. The bobbin 560 is formed by a hollow cylinder extending from the inner circumferential edge of the annular frame 52 in a direction perpendicular to the major surface of the positioning member 5 (i.e., the upward direction, as viewed in FIG. 12). The bobbin 560 is slightly greater in height than the coil 2 and has a flange or rim 561 (i.e., an annular protrusion) formed on an outer end portion thereof. The bobbin 560 functions as a coil holder, like the coil holders 56 of the first embodiment, to retain or hold the coil 2 on the annular frame 52 of the positioning member 5.

The coil 2 is fit at an inner periphery 22 thereof on the outer circumference of the bobbin 560. The rim 561 is snap-fit on the upper edge of the coil 2 to hold the coil 2 firmly on the bobbin 560.

The bobbin 560 may be formed to extend from the whole of or partially from the inner circumferential edge of the annular frame 52. Similarly, the rim 561 may be formed to extend from the whole of or partially from the outer end portion of the bobbin 560.

The production of the reactor 1 is achieved by making a sub-assembly of the coil 2 and the positioning member 5, putting the sub-assembly in the casing 4 together with the magnetic powder/resin mixture 30, and rotating the positioning member 5 to stir or knead the magnetic powder/resin mixture 30 through the fins 51. Specifically, the reactor 1 is produced in the same manner as in the second embodiment. Other arrangements are identical with those in the first embodiment, and explanation thereof in detail will be omitted here.

Figure 14:
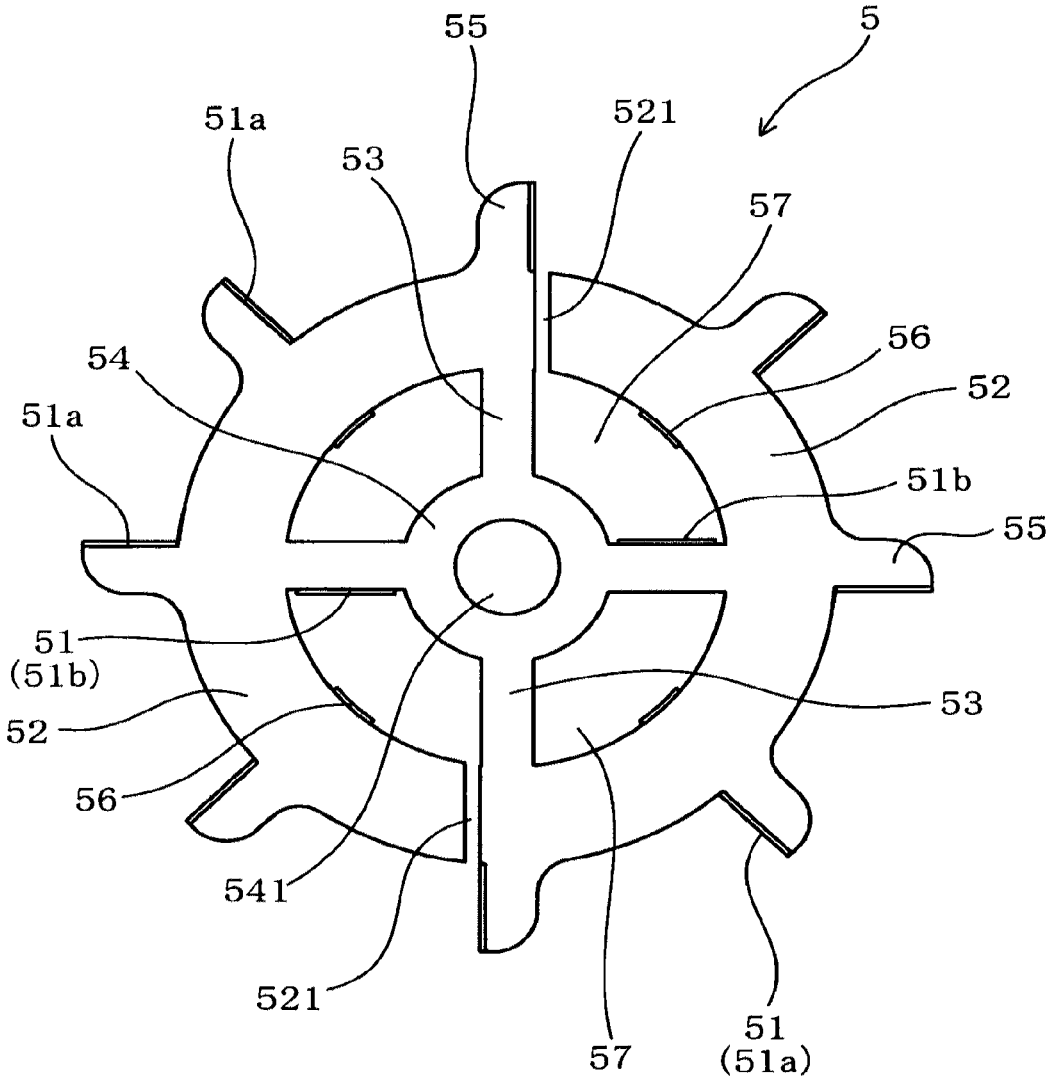
FIG. 14 is a plane view which shows a positioning member in the fourth embodiment.
Figure 15:
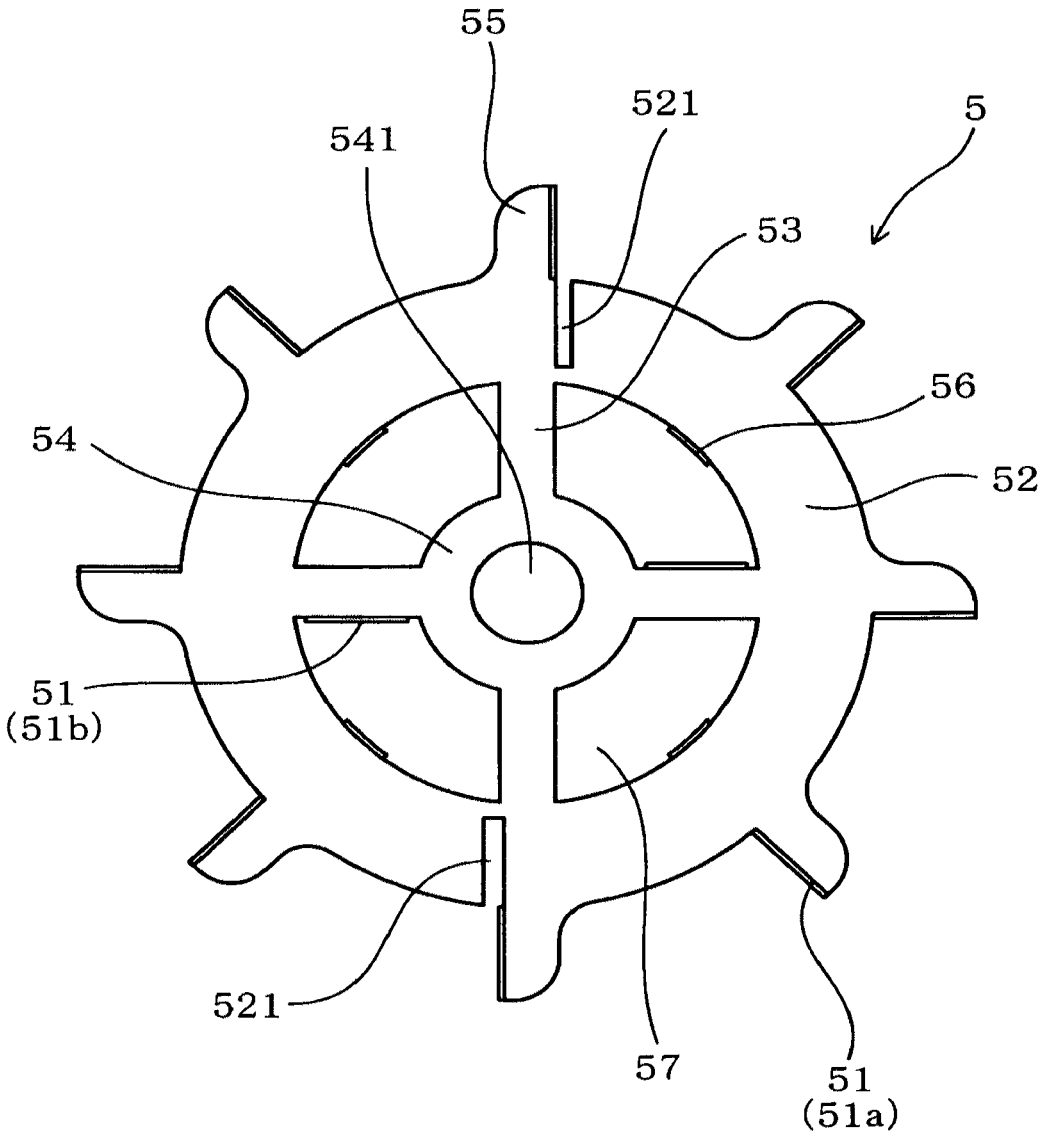
FIG. 15 is a plane view which shows a modification of the positioning member of FIG. 14.
Figure 16:
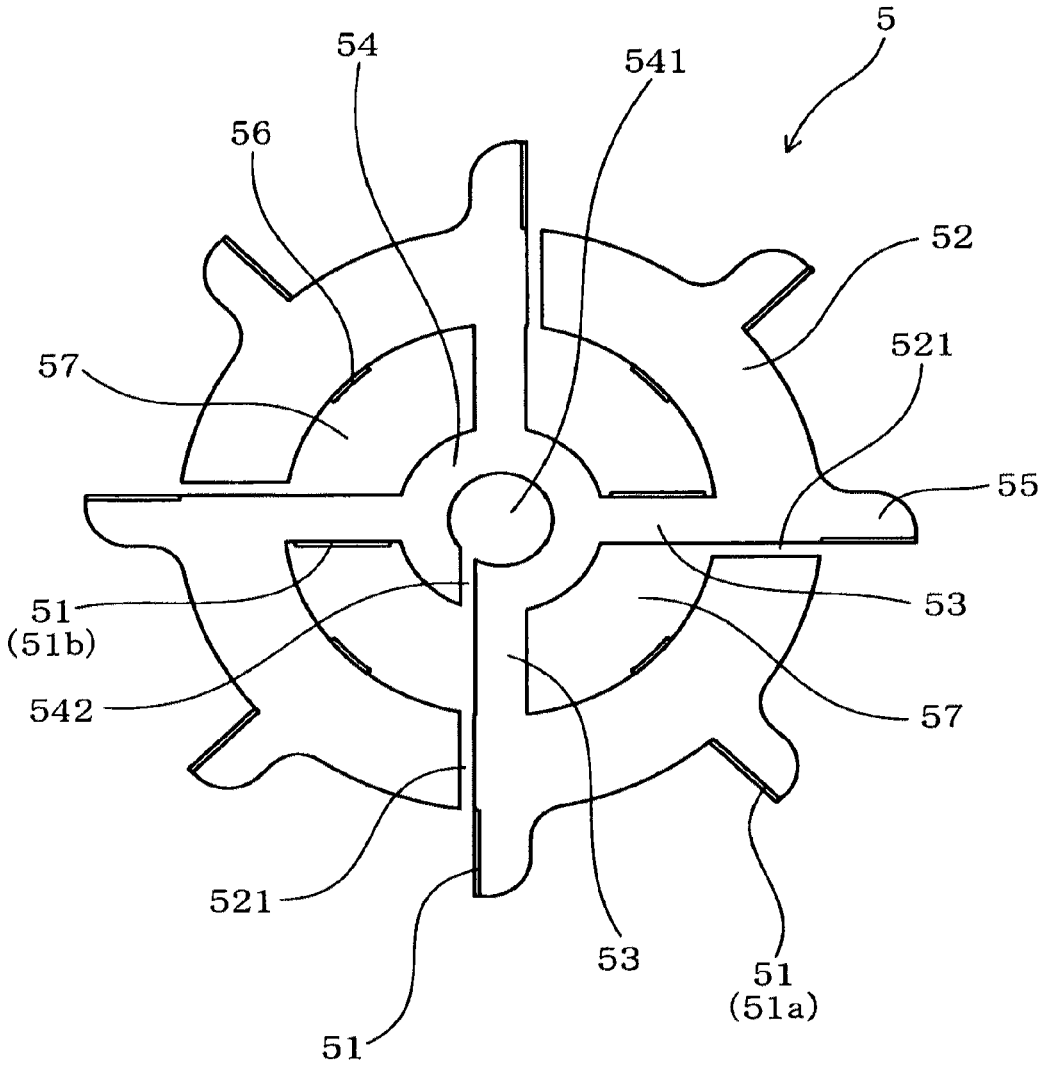
FIG. 16 is a plane view which shows a second modification of the positioning member of FIG. 14.

FIGS. 14 to 16 illustrate the positioning member 5 of the fourth embodiment which has slits 521 formed in the annular frame 52. The slits 521 extend radially of the annular frame 52.

Each of the slits 521 is formed on an extension of one of side edges (i.e., a forward side edge in the direction of rotation of the positioning member 5) of one of diametrically opposed two of the spokes 53. Each of the slits 521, as illustrated in FIG. 14, extends over the whole of width of the annular frame 52.

FIG. 15 shows a modification of the positioning member 5 of FIG. 14. Each of the slits 521, unlike the one of FIG. 14, extends partially through the width of the annular frame 52. Each of the slits 521 is formed by cutting a portion of the width of the annular frame 52 from the outer edge thereof, but may alternatively be formed by cutting the annular frame 52 from the inner edge thereof. In either case, each of the slits 521 preferably occupies over half the width of the annular frame 52.

FIG. 16 shows the second modification of the positioning member 5 of FIG. 14. The positioning member 5 has four slits 521 formed in the annular frame 52 at a regular interval (45 degrees) away from each other and a slit 542 formed in the hub 54.

Each of the slits 521 is formed on an extension of one of the side edges (i.e., the forward side edge in the direction of rotation of the positioning member 5) of one of the spokes 53. The slit 542 is formed on the extension of one of the side edges (i.e., the forward side edge in the direction of rotation of the positioning member 5) of one of the spokes 53.

Each of the slits 521, as illustrated in FIG. 16, extends over the whole of width of the annular frame 52. Similarly, the slit 542 extends over the whole of the width of the hub 54. The slits 521 and 542 may alternatively be so formed as to cut portions of the widths of the annular frame 52 and the hub 54, respectively. Other arrangements are identical with those in the first embodiment, and explanation thereof in detail will be omitted here.

The structure of the positioning member 5, as illustrated FIGS. 14 to 16, serves to avoid a flow of eddy current therein to ensure desired magnetic characteristics of the reactor 1 and minimize a undesirable rise in temperature of the reactor 1.

Specifically, in the case where the positioning member 5 is made of a metallic conductive material, the eddy current will be set up in the positioning member 5 by the magnetic field created around the core 3 during operation of the reactor 1. When the positioning member 5 has the configuration of FIG. 5, the eddy current may become great, thus interfering with the magnetic flux produced in the reactor 1, which leads to a deterioration in performance of the reactor 1. The eddy current may also result in a rise in temperature of the reactor 1.

In order to avoid the above problems, the positioning member 5 has the slits 521 and/or 542. The positioning member 5 of FIG. 14 or 15 serves to cut or break the flow of the eddy current passing through the circumference of the annular frame 52. The slits 521 of FIG. 14 cut the whole width of the annular frame 52, thus breaking the flow of the eddy current completely as compared with the slits 521 of FIG. 15. The slits 521 of FIG. 15 which are so formed as to cut only the portions of the width of the annular frame 52, however, serve to ensure a greater degree of rigidity or mechanical strength of the positioning member 5 as compared with the structure of FIG. 14.

The positioning member 5 of FIG. 16 works to reduce the effects of the eddy current more greatly than FIGS. 14 and 15. Specifically, the slit 542 formed in the hub 54 breaks the flow of the eddy current through the hub 54. Additionally, the four slits 521 extend from the side of all the spokes 53, thereby breaking flows of the eddy current through all loops, as defined by the annular frame 52, the spokes 53, and the hub 54 around the respective windows 57. The structure of the positioning member 5 of FIG. 16 is the most effective to reduce the adverse effects of the eddy current.

Figure 17:
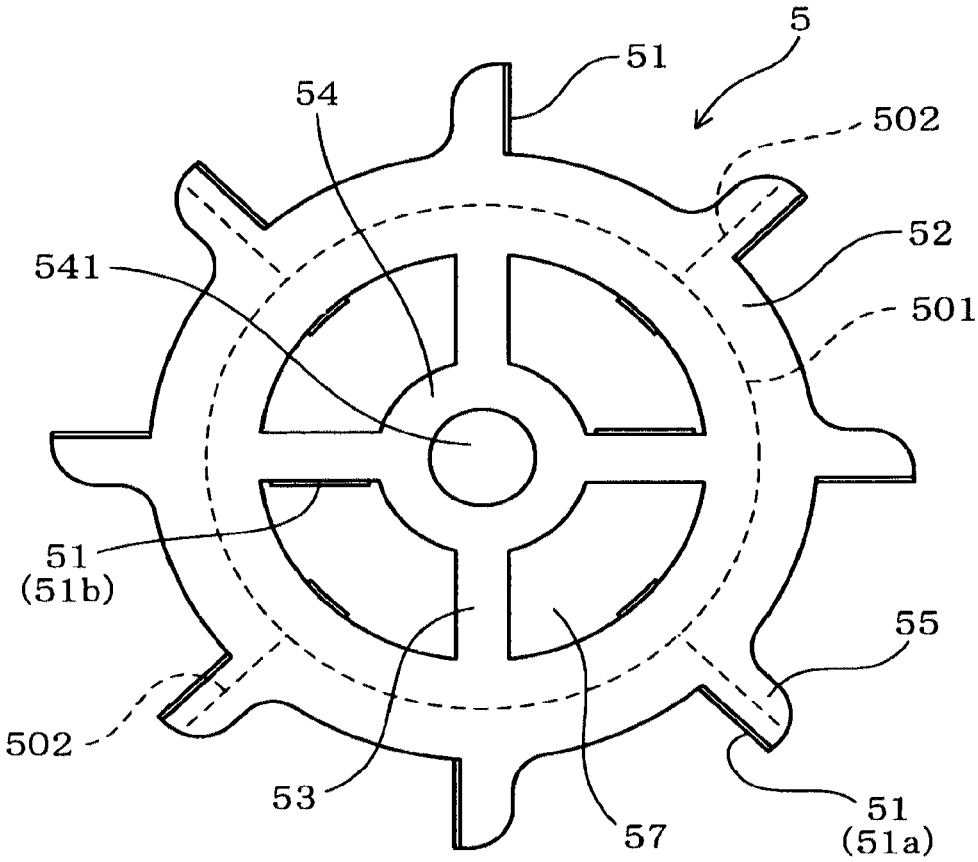
FIG. 17 is a plane view of a positioning member in the fifth embodiment.
Figure 18:
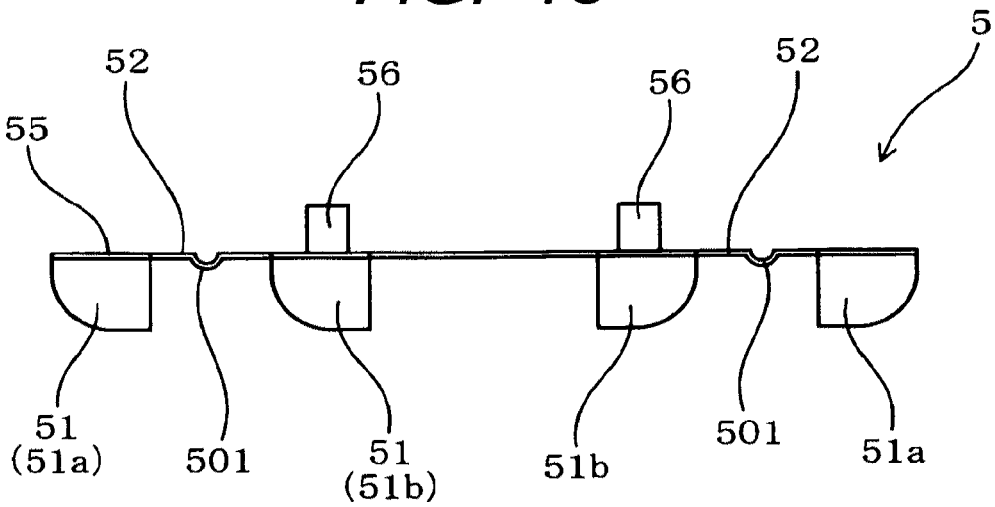
FIG. 18 is a side view of the positioning member of FIG. 17.

FIGS. 17 and 18 illustrate the positioning member 5 of the fifth embodiment which has ribs 501 and 502 extending in the annular frame 52 and the fins 51.

The rib 501 is, as can be seen in FIG. 18, made by a groove which is recessed in the thickness of the annular frame 52 and extends over the entire length of the longitudinal center line of the annular frame 52. The four ribs 502 extend from the rib 501 perpendicular thereto outwardly up to the tops of four of the outer fins 51*a*. Each of the ribs 501 and 502 is of a semi-circular in traverse section and bulges downward, as viewed in FIG. 18.

The ribs 501 and 502 enhance the mechanical strength of the positioning member 5 and also permit the weight of the positioning member 5 to be decreased. The decrease in weight may be achieved by decreasing the thickness of a metallic plate forming the positioning member 5, which results in a decrease in interference thereof with the magnetic flux.

Figure 19:
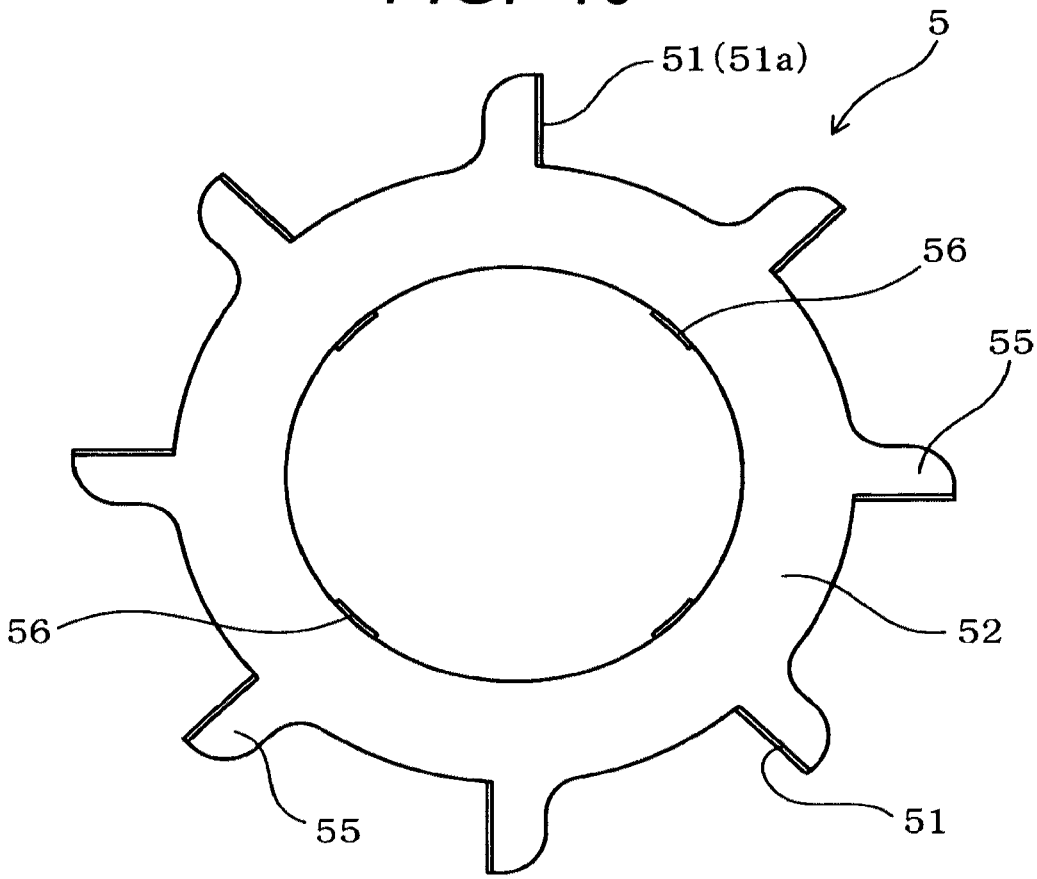
FIG. 19 is a plane view of a positioning member in the sixth embodiment.
Figure 20:
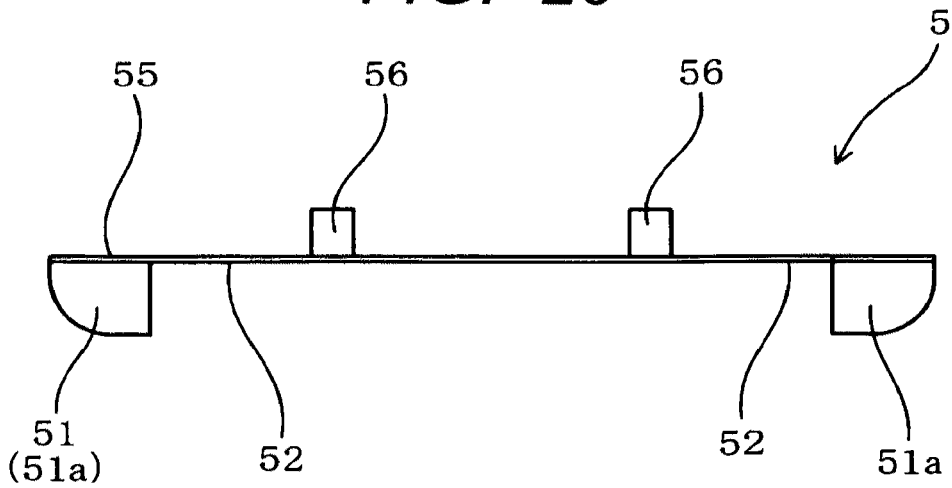
FIG. 20 is a side view of the positioning member of FIG. 19.

FIGS. 19 and 20 illustrate the positioning member 5 of the sixth embodiment which is made up of the annular frame 52, the outer protrusions 55, the outer fins 51*a*, and the coil holders 56. In other words, the positioning member 5 of this embodiment does not have the hub 54, the spokes 53, and the inner fins 51*b* of the one in the first embodiment. Other arrangements are identical with those in the first embodiment, and explanation thereof in detail will be omitted here.

The structure of the positioning member 5 is effective not to interfere with magnetic paths extending inside the coil 2.

Figure 21:
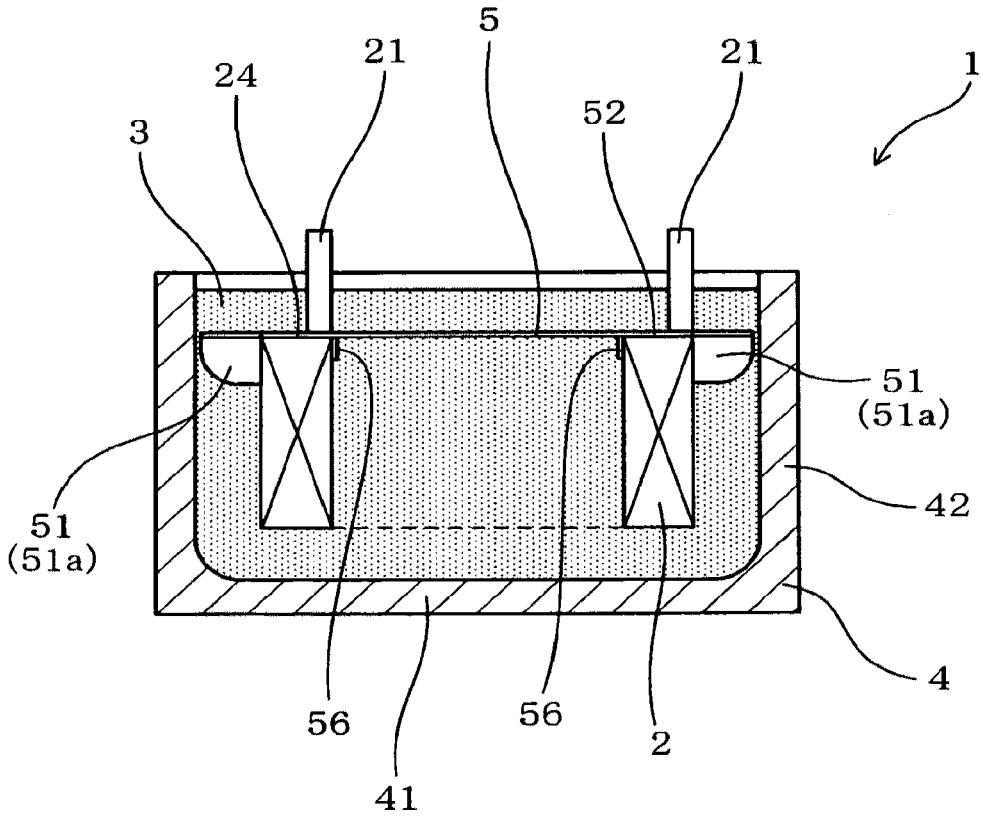
FIG. 21 is a longitudinal sectional view which shows a reactor according to the seventh embodiment.
Figure 22:
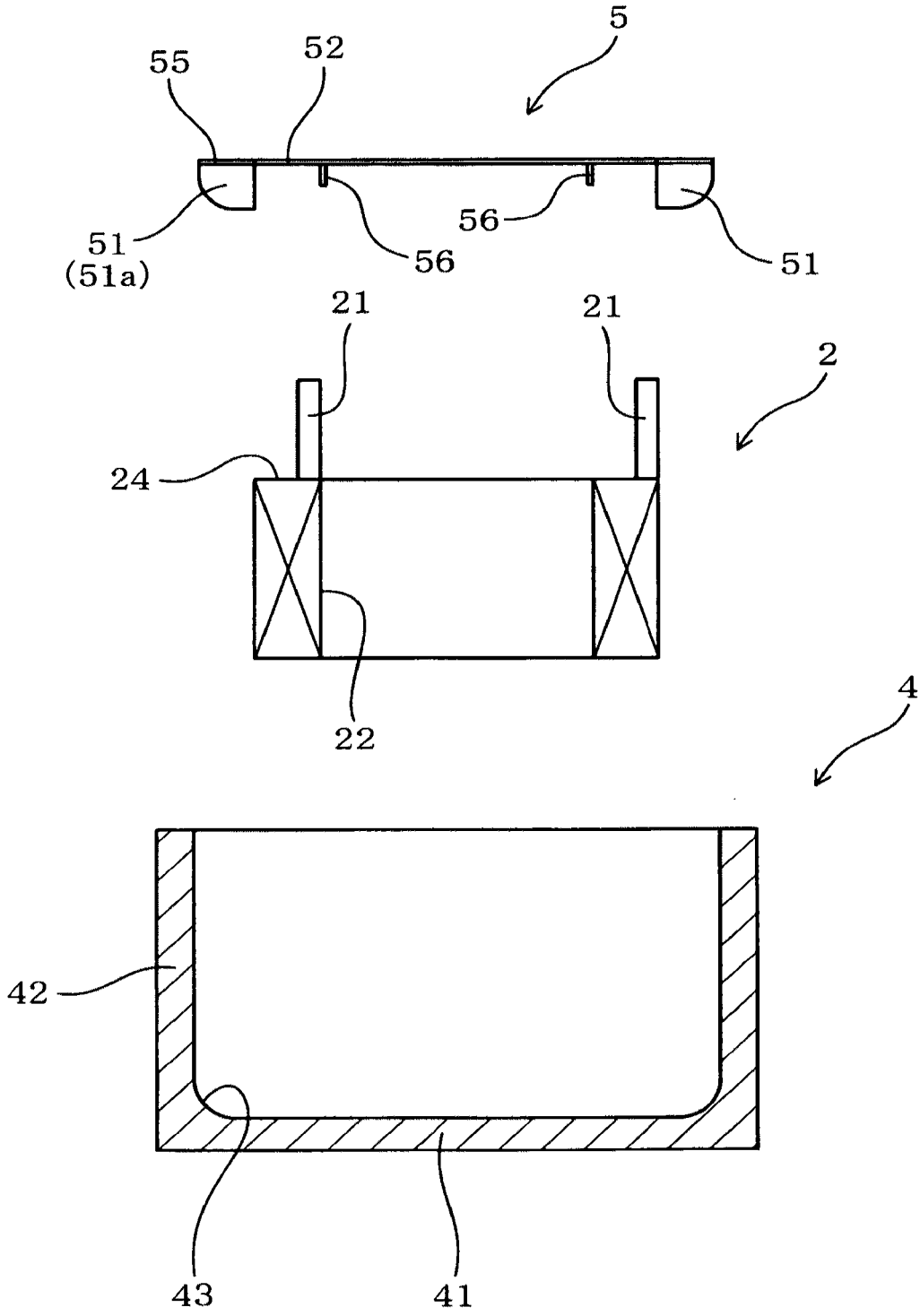
FIG. 22 is an exploded view which shows the reactor of FIG. 21.
Figure 23:
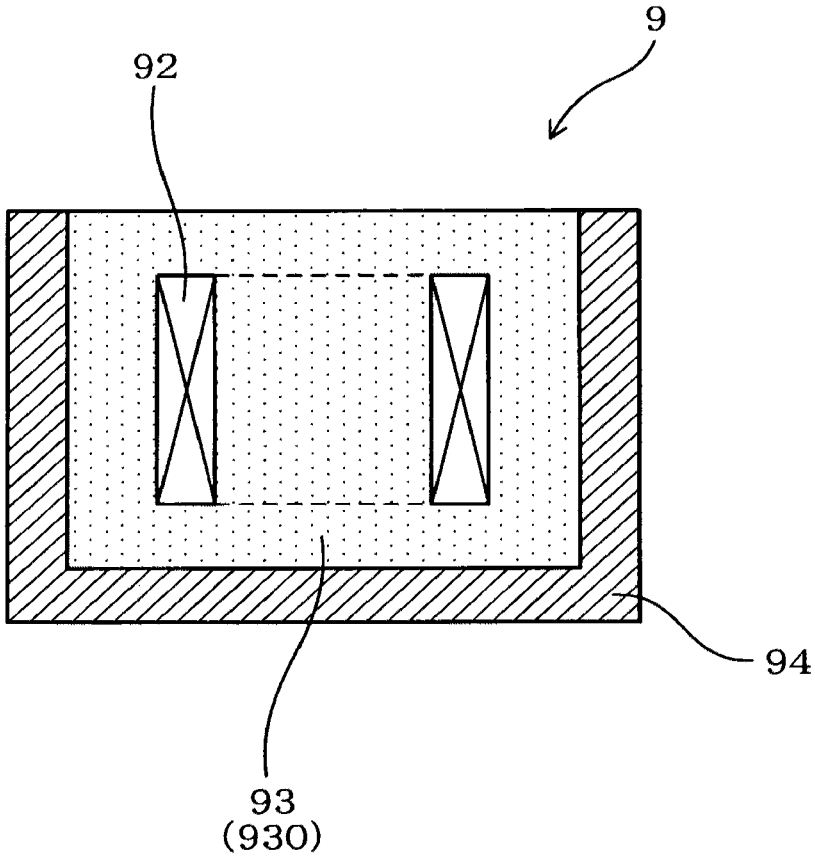
FIG. 23 (PRIOR ART)
FIG. 23 is a longitudinal sectional view which shows a prior art reactor.
Figure 24:
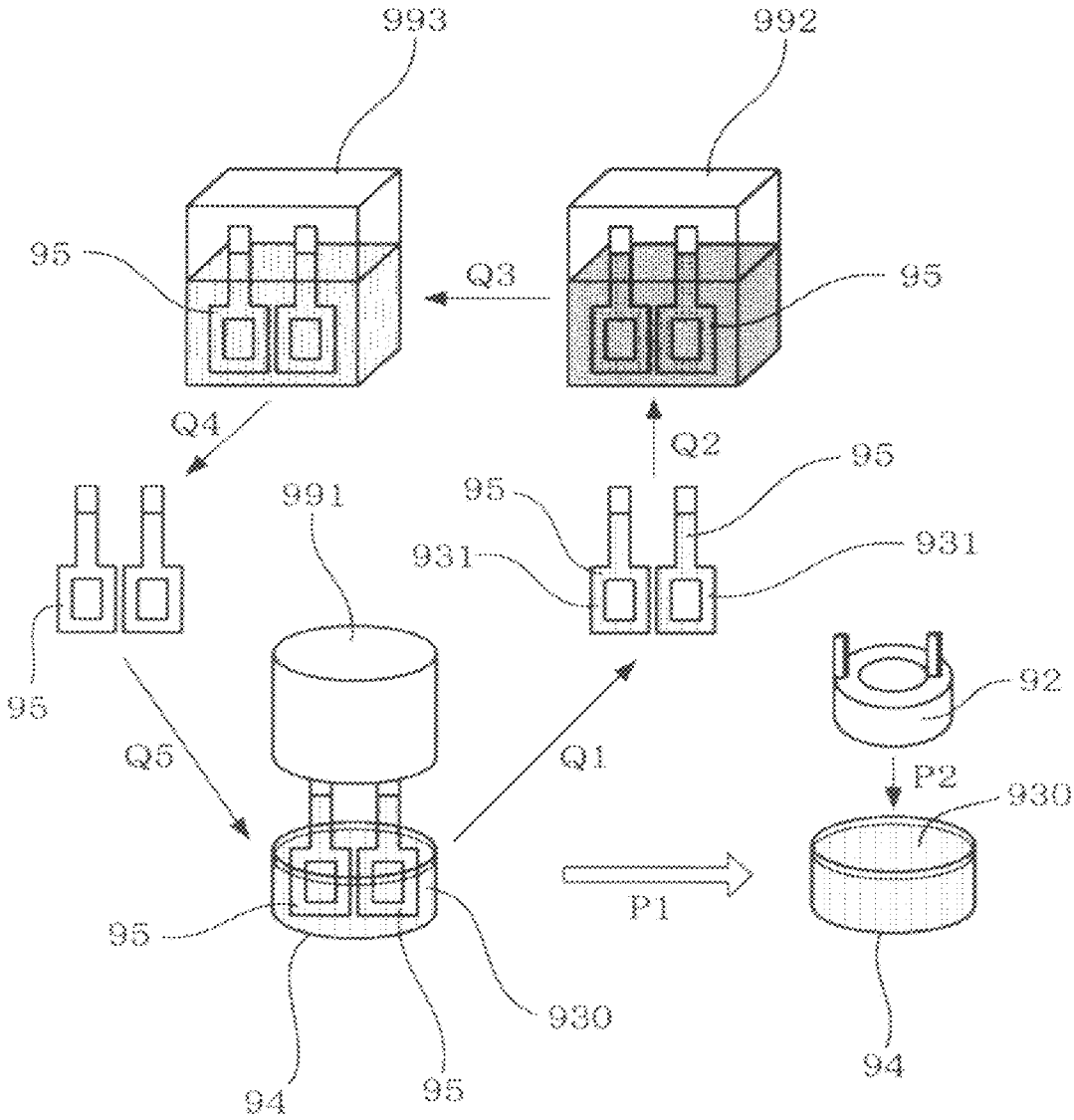
FIG. 24 (PRIOR ART)
FIG. 24 is a view which illustrates a sequence of steps of producing the reactor of FIG. 23.

FIGS. 21 and 22 illustrate the reactor 1 of the seventh embodiment which has the positioning member 5 disposed on the upper end of the coil 2.

The positioning member 5 of this embodiment works to determine the layout of the coil 2 only in the radial direction of the casing 4. The positioning of the coil 2 in the vertical direction of the casing 4 is achieved using another member.

The positioning member 5 of this embodiment is identical in configuration with the one of the sixth embodiment in FIGS. 19 and 20 except that the coil holders 56 extend downward from the inner circumferential edge of the annular frame 52, that is, in the same direction as the fins 51. The positioning member 5 is placed at the annular frame 52 on the upper end of the coil 2 and holds the coil 2 in engagement at the coil holders 56 with the inner circumferential edge of the coil 2.

The annular frame 52 has formed therein holes (not shown) through which the terminals 21 of the coil 2 pass.

The production of the reactor 1 of this embodiment may be achieved by, like in FIGS. 8(*a*) to 8(*c*), stirring the magnetic powder/resin mixture 30 using the fins 51 of the positioning member 5 and then installing the positioning member 5 on the coil 2 or alternatively by, like in FIGS. 11(*a*) to 11(*c*), installing the positioning member 5 on the coil 2 and then stirring the magnetic powder/resin mixture 30 using the fins 51 of the positioning member 5.

Specifically, the former production method is accomplished in the following steps. First, required quantities of insulating resin and magnetic powder are put in the casing 4. The positioning member 5 is then placed within the casing 4. The positioning member 5 is rotated while being moved vertically to stir or knead the magnetic powder/resin mixture 30 through the fins 51. Next, the positioning member 5 is removed from the magnetic powder/resin mixture 30 within the casing 4 and then mounted on the coil 2. The assembly of the positioning member 5 and the coil 2 is then embedded in the magnetic powder/resin mixture 30. Finally, the magnetic powder/resin mixture 30 is solidified to make the core 3.

The latter production method is accomplished in the following steps. First, the positioning member 5 is installed on the coil 2 outside the casing 4. The assembly of the positioning member 5 and the coil 2 is then set in the casing 4 within which the magnetic powder/resin mixture 30 has already been put. The positioning member 5 is rotated while being moved vertically to stir or knead the magnetic powder/resin mixture 30 through the fins 51. The assembly of the positioning member 5 and the coil 2 is left as it is within the magnetic powder/resin mixture 30. The magnetic powder/resin mixture 30 is then solidified to make the core 3.

In the reactor 1 made in the above production method, the positioning member 5 is placed through a gap between itself and the inner surface of the side wall 42 of the casing 4, but serves to ensure the required radial location of the coil 2 within the casing 4.

Other arrangements are identical with those in the first embodiment, and explanation thereof in detail will be omitted here.

Figure 6:
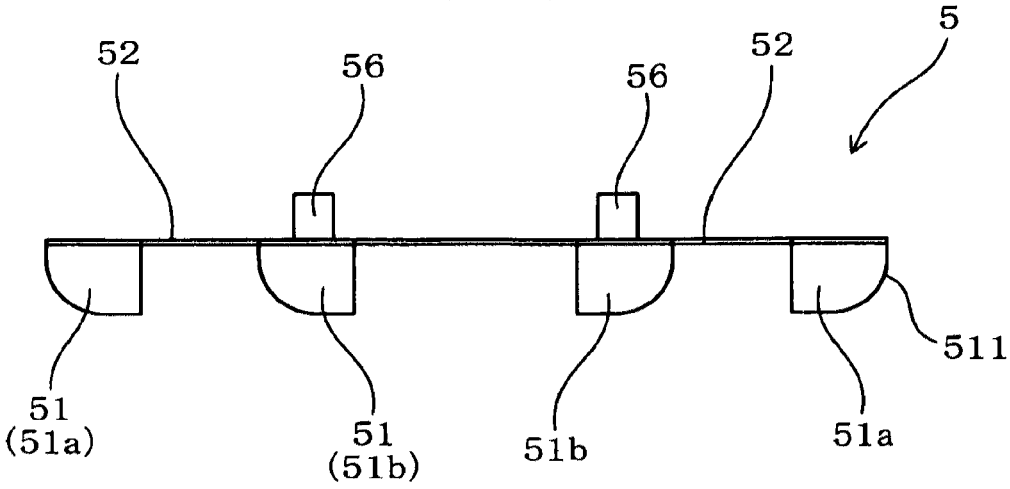
FIG. 6 is a side view of the positioning member of FIG. 4.
Figure 7:
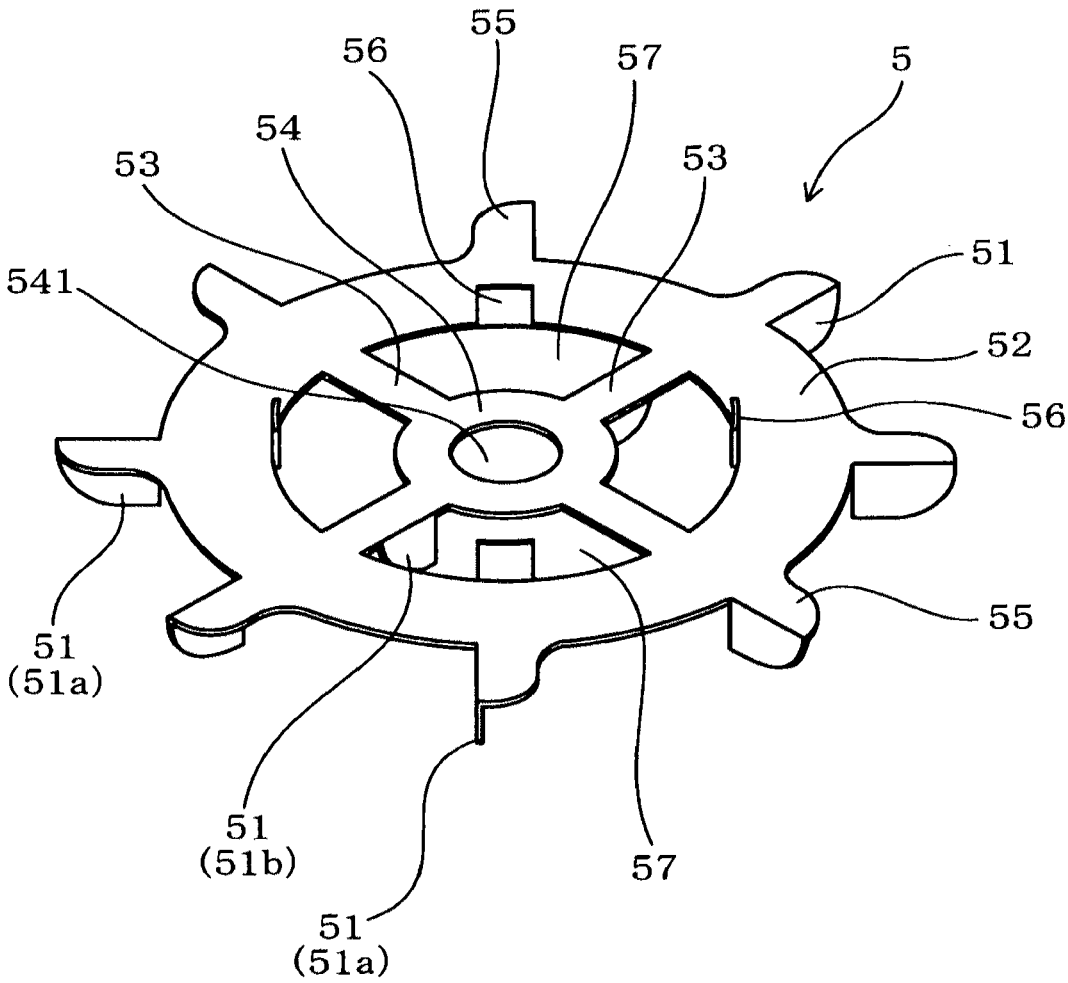
FIG. 7 is a perspective view which illustrates the positioning member of FIG. 4.

The positioning member 5 of the seventh embodiment may also be equipped with the inner fins 51*b* and the spokes 53, as illustrated in FIGS. 5 to 7.

While the present invention has been disclosed in terms of the preferred embodiments in order to facilitate better understanding thereof, it should be appreciated that the invention can be embodied in various ways without departing from the principle of the invention. Therefore, the invention should be understood to include all possible embodiments and modifications to the shown embodiments which can be embodied without departing from the principle of the invention as set forth in the appended claims.

Instead of the nonmagnetic material, such as stainless steel or aluminum, the positioning member 5 may be made of a magnetic material. This eliminates the interference of the positioning member 5 with the magnetic paths in the reactor 1 and minimizes a change in magnetic characteristics of the reactor 1 arising from the presence of the positioning member 5. The degree of freedom of designing the shape of the positioning member 5 is, therefore, increased, thus facilitating ease with which the high-strength positioning member 5 is produced.

In the production of the reactor 1, the positioning member 5 is turned around the central opening 541 of the hub 54 to circulate the fins 51 to stir or knead the magnetic powder/resin mixture 30, but such kneading may be achieved in another manner. For instance, the positioning member 5 may be turned while being moved up and down or switched in rotation between the normal and reverse directions cyclically. The fins 51 may alternatively be reciprocated without being circulated.

The magnetic powder/resin mixture 30 may be stirred or kneaded within a vessel such as a mold separate from the casing 4 and then put in the casing 4. Specifically, the assembly of the positioning member 5 and the coil 2 is put in the vessel and then turned to stir and knead the magnetic powder/resin mixture 30 within the vessel. The magnetic powder/resin mixture 30 is then solidified to make the core 3. The core 3 in which the positioning member 5 and the coil 2 are embedded is removed from the vessel and then put in the casing 4. The positioning member 5 serves to fix the location of the coil 2 relative to the magnetic powder/resin mixture 30 within the vessel and also to stir or knead the magnetic powder/resin mixture 30 within the vessel.

What is claimed is:

1. A reactor comprising:

a coil that produces a magnetic flux when energized;

a core that is made of a solidified mixture of magnetic powder and resin and has the coil embedded therein;

a casing in which the coil and the core are disposed;

a positioning member disposed in the casing to position the coil relative to the casing, the positioning member being equipped with fins configured to stir the mixture of magnetic powder and resin before solidified;

wherein the casing includes a bottom and a side wall extending from a peripheral edge of the bottom, wherein the coil has ends opposed to each other and is disposed with one of the opposed ends facing the bottom of the casing, and wherein the positioning member has an frame on which the coil is disposed at one of the opposed ends thereof and the fins formed on the frame.

2. A reactor as set forth in claim 1, wherein the positioning member is made of material which is higher in thermal conductivity than the core and placed in contact abutment with an inner wall of the casing.

3. A reactor as set forth in claim 1, wherein the positioning member is made of a magnetic material.

4. A reactor as set forth in claim 1, wherein the positioning member has formed integrally therewith a bobbin around which the coil is wound.

5. A reactor as set forth in claim 1, wherein the casing is made up of a bottom and a cylindrical side wall extending from a peripheral edge of the bottom, wherein the coil has ends opposed to each other in an axial direction thereof and is disposed with one of the opposed ends facing the bottom of the casing, and wherein the positioning member has an annular frame on which the coil is disposed at one of the opposed ends thereof and the fins formed on an outer circumference of the annular frame.

6. A reactor as set forth in claim 5, wherein the positioning member also includes spokes extending radially inside the annular frame and inner fins formed on the spokes.

7. A reactor as set forth in claim 5, wherein the positioning member is made of a bent metal plate and has a rib formed by a portion of the metal plate which bulges in a thickness-wise direction of the metal plate.

8. A reactor as set forth in claim 5, wherein the bottom is of a circular shape, and the cylindrical side wall is formed by a circular hollow cylinder.

9. A reactor as set forth in claim 8, wherein the positioning member is interposed between the coil and the bottom of the casing, wherein the casing has a round inner corner extending between the bottom and the cylindrical side wall, the round inner corner being of an arc-shape in cross section taken in an axial direction of the casing, wherein a maximum diameter of the positioning member is smaller than a diameter of an inner circumference of the cylindrical side wall, and wherein the fins formed on the outer circumference of the annular frame each have an arc-shaped edge placed in abutment with the bottom and the inner corner of the casing, the arc-shaped edge being smaller in radius of curvature than the inner corner of the casing.

* * * * *